United States Patent [19]

Yoshii et al.

[11] Patent Number: 5,022,849

[45] Date of Patent: Jun. 11, 1991

[54] LOW NOX BURNING METHOD AND LOW NOX BURNER APPARATUS

[75] Inventors: Yasuo Yoshii, Katsuta; Shigeru Azuhata; Norio Arashi, both of Hitachi; Kenichi Sohma, Ibaraki; Tooru Inada; Hideo Kikuchi, both of Hitachi; Masayuki Taniguchi, Katsuta; Kiyoshi Narato, Ibaraki; Hironobu Kobayashi, Katsuta; Tadayoshi Murakami, Hitachi; Michio Kuroda, Hitachi; Yoji Ishibashi, Hitachi, all of Japan; Stephen M. Masutani, Honolulu, Hi.

[73] Assignee: Hitachi, Ltd., Tokyo, Japan

[21] Appl. No.: 379,926

[22] Filed: Jul. 14, 1989

[30] Foreign Application Priority Data

Jul. 18, 1988 [JP] Japan ..... 63-176914

[51] Int. Cl.[5] ..... F23Q 9/00

[52] U.S. Cl. ..... 431/2; 431/284; 431/12

[58] Field of Search ..... 431/284, 278, 2, 6, 431/12

[56] References Cited

U.S. PATENT DOCUMENTS

| | | | |
|---|---|---|---|
| 4,347,052 | 8/1982 | Reed et al. | 431/284 X |
| 4,395,223 | 7/1983 | Okigami et al. | 431/284 X |
| 4,618,323 | 10/1986 | Manseur | 431/284 X |
| 4,626,195 | 12/1986 | Sato et al. | 431/284 X |
| 4,629,413 | 12/1986 | Michelson et al. | 431/284 X |

FOREIGN PATENT DOCUMENTS

| | | |
|---|---|---|
| 61-41810 | 2/1986 | Japan . |
| 62-210313 | 9/1987 | Japan . |
| 62-62245 | 12/1987 | Japan . |

*Primary Examiner*—Larry Jones

*Attorney, Agent, or Firm*—Antonelli, Terry, Stout & Kraus

[57] ABSTRACT

A low NOx burning method and apparatus wherein a low air ratio flame burned with an amount of air less than an amount of air in a theoretical air ratio required for burning fuel perfectly is formed, and combustibles discharged from the low air ratio flame are burned at a trailing stream of the low air ratio flame while supplying air. The low air ratio flame is a premixing flame burned by premixing the fuel and air, and combustion of the premixing flames is maintained in the vicinity of the premixing flame. In this way, the generation of the NOx during the burning can be greatly decreased, and the required apparatus can be small-sized.

25 Claims, 13 Drawing Sheets

LOW NOX BURNING METHOD AND LOW NOX BURNER APPARATUS

BACKGROUND OF THE INVENTION

The present invention relates to burning method and apparatus for burning gaseous fuel, and more particularly, it relates to a low NOx burning method and a low NOx burner apparatus suitable to reduce the generation of nitrogen oxide (referred to as "NOx" hereinafter) during the burning of the fuel.

The NOx generated during the burning of the fuel includes thermal NOx formed by oxidizing the nitrogen in the combustion air, and fuel NOx formed by oxidizing the nitrogen in the fuel.

In general, most of the gaseous fuels used in the industry, such as natural gas, have a low nitrogen content, except special fuels such as fuel manufactured by gasifying the coal. The NOx generated by burning the fuel and having the low nitrogen content is the thermal NOx formed by oxidizing the nitrogen in the air. The formation of the thermal NOx greatly depends upon the temperature, and an amount of the generated NOx increases in proportion to the flame temperature. Conventional low NOx burning techniques are mainly based on the principle of reduction of the flame temperature, and comprise an exhaust gas recycling method wherein combustion exhaust gas having low density of oxygen is mixed into the combustion air or a two-stage burning method in which the combustion air required for perfect combustion is introduced after the fuel is burned with a low air ratio, without burning the fuel with the air ratio of 1 or thereabout (which results in the maximum flame temperature), i.e., without burning the fuel with a theoretical air amount or thereabout required for the perfect combustion, or the like. Further, there exists a so-called furnace denitrification technique which does not have the purpose of reducing the flame temperature and wherein the fuel is introduced at two stages and a part of the fuel is used as a reducing agent for the generated NOx. It was already ascertained that these burning technique were effective to suppress the generation of the NOx by using them with the actual boiler and the like. However, with these conventional burning techniques, there arose problems that the burning flame was lengthened, and the burner was large-sized and expensive. Accordingly, an economical burning technique has been still requested.

In order to make the burning apparatus compact, i.e., to increase the load for the burning apparatus so that a large amount of fuel can be burned by the small-sized burning apparatus, the length of the flame must be shortened.

In the normal burning apparatus, a so-called diffusive flame technique wherein the fuel and the combustion air are discharged from different nozzles and are mixed together in the burning apparatus is often employed, for the reasons that it can prevent a so-called back fire, in which phenomenon the flame returns to the fuel supplying tube and/or air supplying tube, since the nozzle for the fuel is different from the nozzle for the air, thereby obtaining the safety operation of the burning apparatus, and that a stable flame can be obtained by creating a low flow speed area in the mixing portion between the fuel and air. However, with diffusive flame, the burning time is increased by the time required for mixing the fuel and air and the flame tends to be lengthened.

For this reason, in order to shorten the flame length, a premixing flame technique wherein the premixed fuel and air mixture is introduced into the burning apparatus is employed. However, the premixing flame technique has a severe condition for forming the stable flame and limits the supplying speed and the like. Particularly, a condition that the flame is stably formed is obtained when the fuel is burned with the air ratio (ratio between the amount of the supplied air and the theoretical amount of air required for perfectly burning the fuel) of 1 or thereabout. That is to say, this condition is the same as a condition that the flame temperature is highest. Thus, in this condition, the thermal NOx is readily generated. For this reason, a burning method wherein the flame burned with the air ratio less than 1 and the flame burned with the air ratio more than 1 are simultaneously formed, thus burning the fuel without using the air ratio leading to the increased temperature of the flame has been used. For example, Japanese Patent Publication No. 62-62245 discloses a premixing combustion burner comprising a premixing flame type nozzle for discharging combustion air having an amount more than a theoretical air amount required for burning liquid fuel into a combustion chamber, a diffusive flame type nozzle for discharging combustion air having an amount less than the theoretical air amount required for burning the liquid fuel, and a fuel spray for spraying the liquid fuel into the air flow discharged from the nozzles, and wherein a recycling exhaust gas discharging nozzle for discharging the recycling exhaust gas in parallel with air discharged from the diffusive flame type nozzle is arranged between the premixing flame type nozzle and the diffusive flame type nozzle and a direction of the air discharged from the premixing flame type nozzle is inclined so that the premixing flame type nozzle is diverged from the diffusive flame type nozzle.

Also in this case, the area where the flame temperature is increased can be avoided and it is expected that the generation of the NOx is greatly reduced; however, since the flame burned with the low air ratio is the diffusive flame, an area having the air ratio of 1 or thereabout is created in the mixing area between the fuel and air, thus creating an area where a large amount of NOx is generated. Further, since the flame burned with the low air ratio and the flame burned with the high air ratio are separately formed, there arises a problem that the flame is lengthened by the time when the both flames are mixed.

Further, a burner using a pilot flame for holding unstable premixing flame is already known, as disclosed in Japanese Patent Unexamined Publication No. 62-210313. However, in this conventional burner, since the main flame has the same air ratio as that of the pilot flame, an operation range where the premixing flame is stably formed is very narrow.

In addition, Japanese Patent Unexamined Publication No. 61-41810 teaches a burning method wherein the generation of the NOx is reduced by mixing the flame burned with the low air ratio and the flame burned with the high air ratio.

SUMMARY OF THE INVENTION

An object of the present invention is to provide a low NOx burning method and a low NOx burner apparatus which can effectively decrease the NOx generated during the burning and, particularly, can effectively reduce the generation of the NOx in the flame having a length shorter than the conventional flame.

According to one aspect of the present invention, there is provided a low NOx burning method wherein low air ratio flame burned with an amount of air less than an amount of air in a theoretical air ratio required for burning fuel perfectly is formed, and combustibles discharged from the low air ratio flame are burned at a trailing stream of the low air ratio flame while supplying air, and wherein the improvement is that the low air ratio flame is a premixing flame burned by previously mixing the fuel and air, and means for maintaining combustion of the premixing flame is provided in the vicinity of the premixing flame.

The means for maintaining the combustion of the premixing flame comprises flame burned around an outer periphery of the low air ratio flame, the flame being the premixing flame burned by premixing the fuel and the air having substantially the theoretical air ratio required for the substantial perfect combustion, or flame burned by premixing the fuel and air and by using catalyst, or flame burned ahead of the low air ratio flame, and said flame being achieved by the premixing flame burned with an amount of air near the theoretical air amount required for the substantial perfect combustion and by premixing the fuel and air.

Further, according to another aspect of the present invention, there is provided a low NOx burning method wherein a high air ratio flame burned with an amount of air more than the theoretical air amount required for the perfect combustion is formed in coaxial with the low air ratio flame burned with an amount of air less than the theoretical air amount, and wherein the improvement is that means is provided for forming flame completing the combustion of the low air ratio flame and including combustibles not containing oxygen substantially, and the combustibles are burned with the high air ratio flame.

Both of the low air ratio flame and high air ratio flame comprise a premixing flame burned by premixing the fuel and air, premixing flame burned about an outer periphery of the low air ratio flame and an inner periphery of the high air ratio flame by premixing the fuel and the air having an amount substantially the same as the theoretical air amount required for the substantial perfect combustion, or premixing flame burned about an outer periphery of the high air ratio flame and in coaxial with the high air ratio flame by premixing the fuel and the air having an amount substantially the same as the theoretical air amount.

The low NOx burning method according to the present invention includes the steps of forming the high air ratio flame burned by premixing the fuel and the air having an amount more than the theoretical air amount in coaxial with the low air ratio flame burned through the catalyst by premixing the fuel and the air having an amount less than the theoretical air amount, forming the premixing flame burned by premixing the fuel and the air having an amount substantially the same as the theoretical air amount in coaxial with the high air ratio flame, forming the low air ratio flame burned by premixing the fuel and the air having an amount less than the theoretical air amount in a trailing stream of the premixing flame burned by premixing the fuel and the air having an amount substantially the same as the theoretical air amount, and burning the fuel by supplying air required for the substantial perfect combustion in a trailing stream of the low air ratio flame in coaxial with the latter.

In the present invention, the number of the low air ratio flames is the same as that of the means for maintaining the combustion of the low air ratio flame and is plural, and the number of the high air ratio flames is also the same as that of the premixing flames burned with the air amount substantially the same as the theoretical air amount and is plural.

The premixing flame burned with the air amount substantially the same as the theoretical air amount is the pilot flame for assisting to hold the low air ratio flame and/or high air ratio flame.

According to a further aspect of the present invention, there is provided a low NOx burner apparatus comprising a nozzle for forming a low air ratio flame burned with an air amount less than a theoretical air amount required for burning the fuel perfectly, and an air supplying nozzle arranged in coaxial with the aforementioned nozzle, for supplying air to burn combustibles discharged from the low air ratio flame at a trailing stream of the low air ratio flame, and wherein it further comprises means for burning the low air ratio flame by premixing the fuel and air, and means arranged in the vicinity of the low air ratio flame, for holding the combustion of the low air ratio flame. Further, in the present invention, there is provided a low NOx burner apparatus comprising a first nozzle for forming a low air ratio flame burned with an air amount less than the theoretical air amount required for burning the fuel perfectly, and a second nozzle arranged in coaxial with the low air ratio flame, for forming a high air ratio flame burned with an air amount more than the theoretical air amount, and wherein it further comprises a nozzle for forming a pilot flame burned with an air amount substantially the same as the theoretical air amount in coaxial with the nozzles, which nozzle is arranged around an outer periphery of the first nozzle and between the first and second nozzles.

Further, in the present invention, there is provided a low NOx burner apparatus comprising a nozzle for forming a low air ratio flame burned with an air amount less than a theoretical air amount required for burning the fuel perfectly and a nozzle arranged in coaxial with the low air ratio flame, for forming a high air ratio flame burned with an air amount more than the theoretical air amount and wherein combustion catalyst is provided in the tip of the nozzle for forming the low air ratio flame, and the apparatus further comprises a nozzle for burning the fuel with an air amount substantially the same as the theoretical air amount required for burning the fuel perfectly, a nozzle arranged in coaxial with a trailing stream of flame from said nozzle, for forming a low air ratio flame burned with an air amount less than the theoretical air amount, and a nozzle arranged on a trailing stream side of the low air ratio flame, for burning combustibles formed in the low air ratio flame and for supplying air having an amount substantially the same as the theoretical air amount.

Further, the low NOx burner apparatus according to the present invention comprises a plurality of first nozzles each for forming a low air ratio flame burned with an air amount less than a theoretical air amount required for burning the fuel perfectly, and a plurality of second nozzles each arranged in coaxial with the corresponding first nozzle, for burning the fuel with an air amount substantially the same as the theoretical air amount, and further comprises a plurality of third nozzles arranged in the vicinity of the first nozzles, each for forming a high air ratio flame burned with an air amount more than the theoretical air amount, and a plurality of fourth nozzles arranged in coaxial with the third nozzles, each for burning the fuel with an air amount substantially the same as the theoretical air amount.

The present invention further relates to a burner apparatus wherein the fuel is divided into two layers in a longitudinal direction of the apparatus and is introduced independently. In such burner apparatus, means for adjusting flow rate of each of primary and secondary fuels is provided; air having an amount near an air amount required for burning the fuel completely to create an air ratio of about 1 in a primary burning area for burning the primary fuel is introduced; the secondary fuel is introduced at a downstream side of the primary burning area; the secondary fuel is burned in a secondary burning area with an air amount less than that of the air ratio of 1, i.e., less than an air amount required for burning the fuel completely; air having an amount enough to completely burn combustibles remaining by not being burned in the secondary burning area is introduced at a downstream side of the secondary burning area; a plurality of burners are provided for forming the primary burning area; a part of the burners is used as a supplying burner for introducing a premixed mixture obtained by premixing the fuel and air; and a part of burners forms diffusive flame by supplying only the fuel from a nozzle or the fuel and air from different nozzles.

Further, a part of combustion air may be supplied to the secondary fuel introduced at the downstream side of the primary burning area, in response to the load of a gas turbine, to mix then, and the secondary fuel may be introduced into the burner apparatus.

Furthermore, the plurality of burners for forming the primary burning area may comprise a central burner arranged in a center of a combustion barrel, for forming the diffusive flame, and a plurality of burners arranged around the central burner to discharge the premixed mixture in directions tangential to a certain imaginary spiral circle.

The above-mentioned burner apparatus according to the present invention are adapted to be used with a gas turbine and a boiler. In this case, the present invention is particularly suitable to use with a combined power plant wherein, by using the burner apparatus, the gas turbine is rotated by hot exhaust gases discharged from the burner apparatus, the hot exhaust gas discharged from the gas turbine is sent to be boiler having heat transfer tubes therein, a steam turbine is rotated by steam obtained by the heat transfer tubes, and a generator is rotated by the gas turbine and the steam turbine, thereby obtaining an electric power. As a result, it was found that the amount of NOx in the burner apparatus was reduced less than 60 ppm, and was finally reduced 15 ppm by providing a denitrification device in the boiler.

In order to effectively reduce the generation of the NOx, in an area where the combustion gas generated by the high air ratio flame is mixed with the combustion gas generated by the low air ratio flame, it is necessary to complete the combustion with the high air ratio and the combustion with the low air ratio, respectively. Accordingly, in the present invention, the effective low NOx burning method is achieved by using means for forming a laminar flow premixing flame on the roots of the premixing flames burned with high and low air ratios to promote the maintenance of the flames and the combustion.

In the premixing burning method performed by premixing the fuel and air, by burning the fuel in a condition remote from the stoichiometric coefficient of 1.0 where the maximum generation of the NOx is anticipated, the NOx can be greatly reduced and the flame length can be effectively shortened. However, such premixing burning method has a disadvantage that a range of the discharging speeds is narrow and the flame is extremely unstable.

Accordingly, in the present invention, by forming the laminar flow premixing flame on outer peripheries of the turbulent flow premixing flame burned with the low air ratio and the turbulent flow premixing flame burned with the high air ratio, the stability of the turbulent flow premixing flames is improved. Further, with the above-mentioned technical means, by stably forming the premixing flame burned with the high air ratio around the premixing flame burned with the low air ratio, the thermal NOx generated from the premixing flame burned with the high air ratio can be reduced through the reducing chemical species generated from the premixing flame burned with the low air ratio to decrease the NOx, thus reducing the generation of the NOx considerably.

In the burner apparatus according to the present invention, since the flow rates of the fuels constituting the primary and secondary burning areas are controlled independently from each other, it is easy to form the reducing atmosphere. Further, since the premixing flame does not require a process for mixing the fuel and air in the combustion chamber, unlike the diffusive flame, the flame having a length shorter than that of the diffusive flame can be obtained. Therefore, by constituting the flame in the primary burning area by the premixing flame, the primary burning area can be decreased. Further, by constituting a part of the flame by the diffusive flame which is relatively stable and is easy to form and by using such diffusive flame for igniting the premixing flame, it is possible to eliminate the unstableness of the flame due to the premixing flame. In addition, by discharging the premixing flame in the primary burning area as swirl flow, the staying time of the premixing flame in the longitudinal direction of the primary burning area can be shortened, and, by constituting the flame formed in coaxial with the swirl flow by the diffusive flame, such diffusive flame can be used to ignite the premixing flame, thus forming the premixing stably.

Furthermore, by discharging the secondary fuel from a plurality of nozzles toward the center of the burner apparatus, it is possible to promote the mixing of the secondary fuel with the combustion fluid from the primary burning area and to promote the consumption of oxygen remaining in the center of the burner apparatus and the formation of the reducing atmosphere, thus shortening the staying time of the secondary fuel in the secondary burning area. In addition, as a method for decreasing the secondary burning area, by introducing the least air amount required for igniting the secondary fuel as the premixed mixture into the secondary fuel, it is possible to promote the ignition of the secondary fuel and the formation of the reducing atmosphere in the secondary burning area.

DESCRIPTION OF THE PREFERRED EMBODIMENTS

Figure 1A:
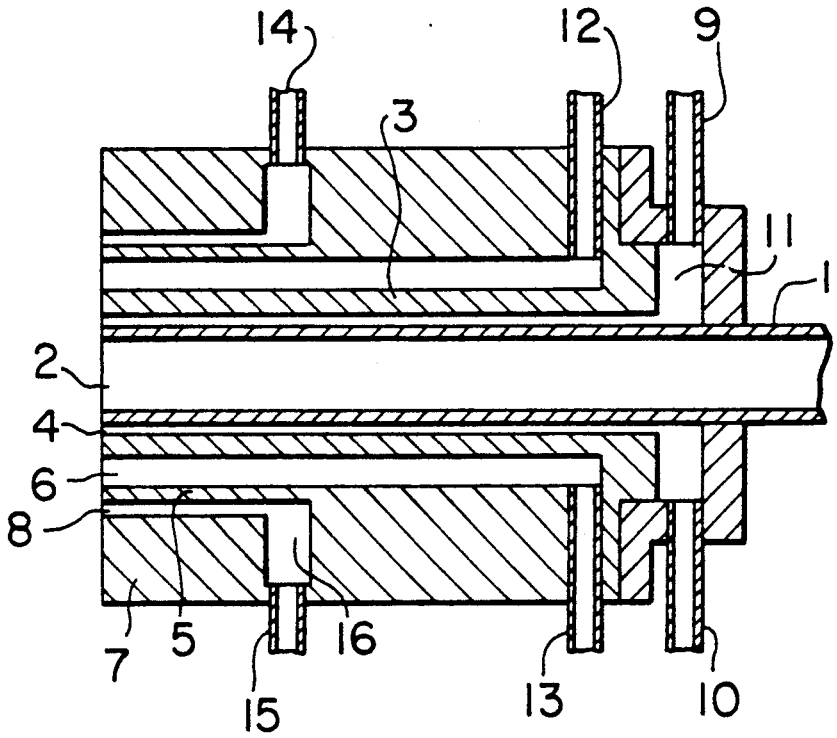
FIG. 1A is a longitudinal sectional view of a burner apparatus according to the present invention.

As shown in FIG. 1A, a cylinder 1 is arranged in a center of the burner apparatus, which cylinder is used as a nozzle 2 for forming a premixing flame burned with a low air ratio. A cylinder 3 is arranged around an outer periphery of the cylinder 1, and an annular flow passage 4 defined between the cylinders 1 and 3 is used as a nozzle 4 for forming a laminar flow premixing flame. A cylinder 5 is arranged around the nozzle 4, and an annular flow passage defined between the cylinders 3 and 5 is used as a nozzle 6 for forming premixing flame burned with a high air ratio. A cylinder 7 is arranged around the nozzle 6, and an annular flow passage defined between the cylinders 5 and 7 is used as a nozzle 8 for forming a laminar flow premixing flame. A premixing chamber 11 connected to a fuel supplying tube 9 and to an air supplying tube 10 is arranged at an upstream side of the nozzle 4. A fuel supplying tube 12 and an air supplying tube 13 are arranged at an upstream side of the nozzle 6. A premixing chamber 16 connected to a fuel supplying tube 14 and to an air supplying tube 15 is arranged at an upstream side of the nozzle 8.

The gaseous fuel and air supplied to the cylinder 1 are mixed together while flowing in the cylinder to create a uniform premixing fluid, by which the premixing flame burned with the low air ratio is formed in the nozzle 2. The fuel and air supplied from the supplying tubes 9 and 10 are mixed in the premixing chamber 11 to create a uniform premixing fluid, by which the laminar flow premixing flame is formed in the nozzle 4. In order to form the stable laminar flow premixing flame in the nozzle 4, it is necessary to set the air ratio of the premixed fluid to a value of 1 or thereabout, where the maximum combustion progresses, and, normally, the air ratio $\lambda$ of the premixed fluid is set to have a value in the range of $0.8<\lambda<1.2$. Further, in order to prevent blowing-out of the laminar flow premixing flame and the back fire, the discharging speed Vp of the premixed fluid may be selected to have a value of 1.0 m/s to 2.0 m/s. The fuel and air supplied from the supplying tubes 12 and 13 to the space between the cylinders 3 and 5 are mixed while flowing in the space to create a uniform premixed fluid, by which the premixing flame burned with the high air ratio is formed in the nozzle 6. The fuel and air supplied from the supplying tubes 14 and 15 are mixed in the premixing chamber 16 to create a uniform premixed fluid, by which the laminar flow premixing flame is formed in the nozzle 8. In order to form the stable laminar flow premixing flame, the air ratio $\lambda$ of the premixed fluid may be set to have a value in a range $0.8<\lambda<1.2$ and the discharging speed Vp of the premixed fluid may be selected to have a value of 1.0 m/s to 2.0 m/s.

Figure 2:
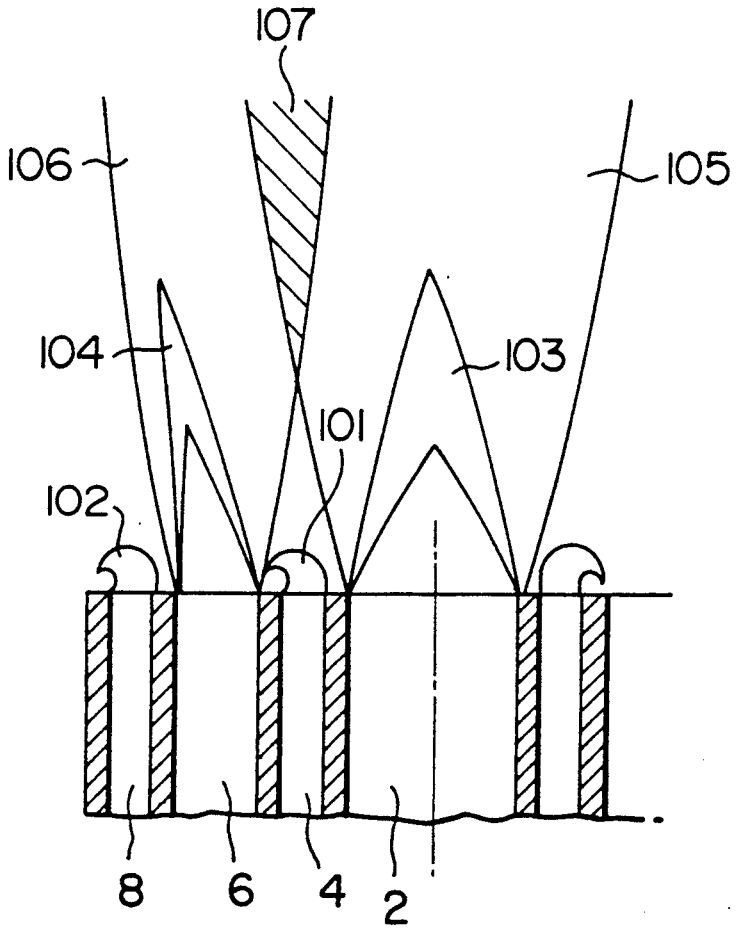
FIG. 2 is a sectional view showing flames generated by a burning method according to the present invention.
Figure 1B:
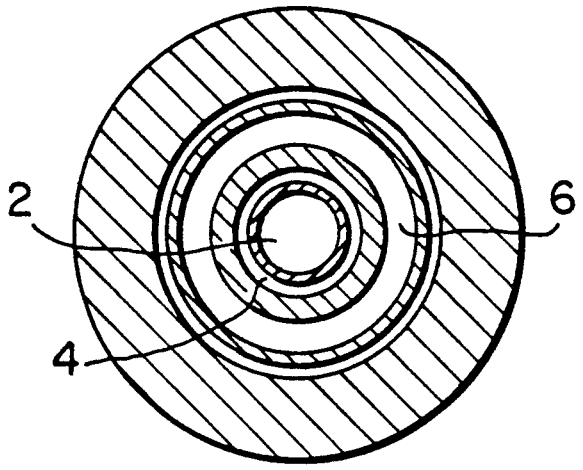
FIG. 1B is an end view of the burner apparatus of FIG. 1A.

Next, a principle of the low NOx burning method according to the present invention will be explained with reference to FIG. 2. As mentioned above, merely by discharging the premixed fluid burned with the low air ratio and the premixed fluid burned with the high air ratio, it is not expected to obtain the reducing efficiency of the NOx. In order to effectively reduce the NOx, in an area where the combustion gas generated by the high air ratio flame and the combustion gas generated by the low air ratio flame are mixed together, it is necessary that the combustion with the high air ratio and the combustion with the low air ratio have been completed. If the fluids are mixed before the combustions are not completed, the combustion progresses merely with the combined or mixed air ratio. For example, if the premixed fuel-air mixture having the air ratio of 0.5 and the premixed fuel-air mixture having the air ratio of 1.5 are mixed with the same amounts before these mixtures are not completely burned, when the combustion goes on, the premixing flame with the air ratio of 1.0 is merely formed, and, thus it is not expected to reduce the NOx in the flames. A key of the present invention is that, in the area where the low air ratio flame and the high air ratio flame are mixed together, both of the flames have been completely burned. That is to say, hot combustion gas including oxygen of about 7% is discharged from the flame with the air ratio of 1.5 and hot combustion gas including substantially no oxygen is discharged from the flame with the air ratio of 0.5, and, by mixing these gases, the NOx formed by the high air ratio flame can be reduced. The burner apparatus shown in FIGS. 1A and 1B is manufactured on the basis of such principle. That is to say, as shown in FIG. 2, the jet of the premixed fluid with the low air ratio discharged from the nozzle 2 is ignited by the laminar flow premixing flame 101 formed in the nozzle 4. Since the ignition is effected by the flame 101 formed in the nozzle 4, a central portion of the jet of the premixed fluid with the low air is in a non-burned condition at the beginning of the discharge thereof, and the flame is transferred toward the central portion as the fluid goes to the downstream side thereof.

The premixed fluid with the high air ratio discharged from the nozzle 6 is ignited by the laminar flow premixing flames 101, 102 formed in the nozzles 4 and 8, thus creating the high air ratio flame 104. The flames so formed are mixed in the downstream side. As in the illustrated embodiment, when the premixed fluid with the low air ratio and the premixed fluid with the high air ratio are both ignited from outer peripheries thereof, in a mixing area 107 created in the downstream side, the combustion of the respective fluid is substantially completed. Further, in the mixing area 107, the hot oxygen discharged from the high air ratio flame is consumed and the combustion product from the high air ratio flame is diffused toward a central portion of the low air ratio flame 103. In the central portion of the low air ratio flame,, there is formed an excessive fuel area 105 having high density of oxygen, where the NOx formed by the high air ratio flame is reduced.

Figure 3:
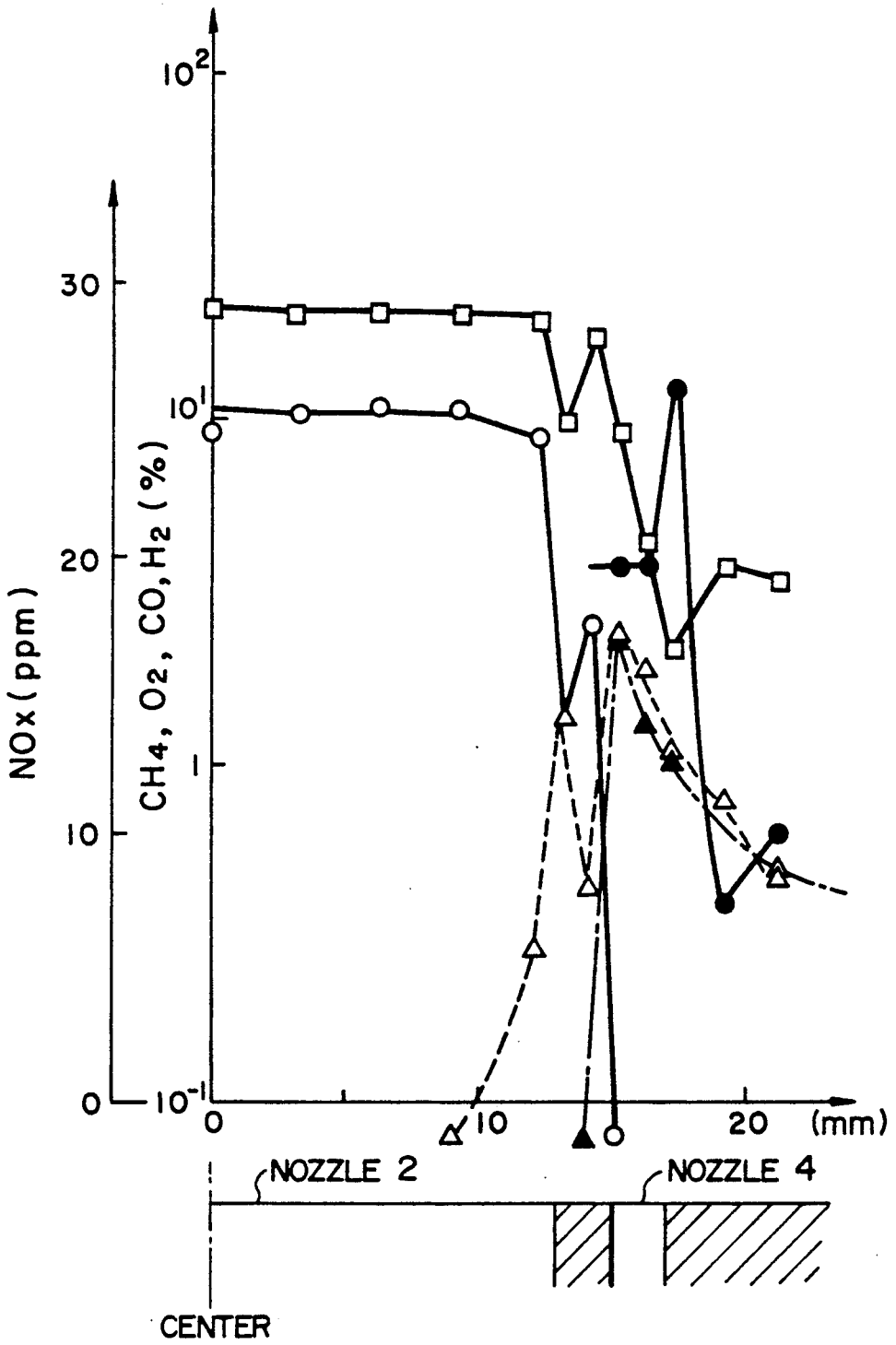
FIG. 3 is a graph showing a relation between a nozzle position and amounts of NOx, $CH_4$, $O_2$, CO and $H_2$.

In the present invention, the perfect combustion of the premixed fluid is carried out. However, in this case, there arises a problem that a range of the air ratio and/or discharging speed for stably forming the premixing combustion flame will be narrow and unstable. In order to solve this problem, according to the present invention, the laminar flow premixing flame was formed on a root of the turbulent flow premixing flame, whereby the turbulent flow premixing flame could be stably burned even at a discharging speed of ten or more meters per second. In FIG. 3, the combustion condition of the turbulent flow premixing flame held by the laminar flow premixing flame was examined. FIG. 3 shows the result of the examination of combustion conditions in the inner portion of the turbulent flow premixing flame and in the vicinity of the laminar flow premixing flame performed by shifting a sampling probe from the center of the premixing nozzle in a radial direction thereof at a position spaced apart from the nozzle by 5 mm in a downstream direction and by picking and analyzing the combustion gases. As seen from FIG. 3, in the inner portion of the turbulent flow premixing flame, the $CH_4$ as the fuel is not almost be burned, but is gradually burned as toward the laminar flow premixing flame, and, at least, the $CH_4$ is substantially completely burned in an upper portion of the laminar flow premixing flame. That is to say, it is apparent that the flame is positively transferred from the laminar flow premixing flame to the premixed fluid discharged from the turbulent flow premixing flame nozzle.

Figure 4A:
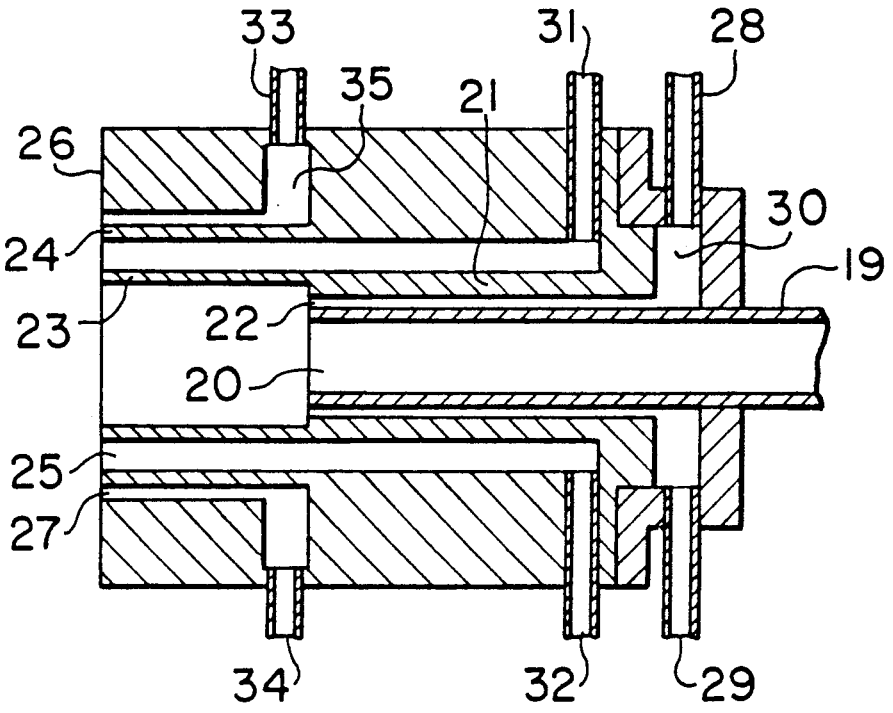
FIG. 4A is a longitudinal sectional view of a burner apparatus according to another embodiment of the present invention.
Figure 4B:
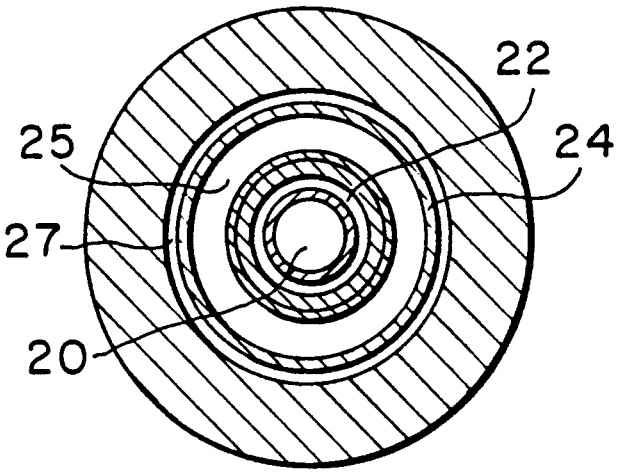
FIG. 4B is an end view of the burner apparatus of FIG. 4A.

FIGS. 4A and 4B show a burner apparatus obtained by improving the burner apparatus of FIGS. 1A and 1B. A premixing nozzle 20 for forming the premixing flame with the low air ratio is constituted by a tip of a cylinder 19 through which the premixed fluid having the low air ratio flows. A cylinder 21 is arranged around an outer periphery of the cylinder 19 to define a nozzle 22 therebetween, which nozzle 22 is used for forming the laminar flow premixing flame. A cylinder 23 is arranged around an outer periphery of the nozzle 22 and at a downstream side of the end faces of the nozzles 20, 22, and a cylinder 24 is arranged around the cylinder 23 with a certain clearance, thus defining a nozzle 25 therebetween, which nozzle 22 is used for forming the premixing flame with the high air ratio. Further, a cylinder 26 is arranged around an outer periphery of the nozzle 25, thus defining a nozzle 27 for forming the laminar flow premixing flame. A premixing chamber 30 connected to a fuel supplying tube 28 and to an air supplying tube 29 is arranged at an upstream side of the nozzle 22. A premixing chamber 35 connected to a fuel supplying tube 33 and to an air supplying tube 34 is arranged at an upstream side of the nozzle 27.

The gaseous fuel and air supplied to the cylinder 19 are mixed together while flowing in the cylinder to create a uniform premixed fluid, by which the premixing flame burned with the low air ratio is formed. The gaseous fuel and air supplied from the supplying tubes 28 and 29 are mixed in the premixing chamber 30 to create a uniform premixed fluid, by which the laminar flow premixing flame is formed in the nozzle 22. In order to form the stable laminar flow premixing flame in the nozzle 22, the combustion condition was so selected that the air ratio $\lambda$ was in a range of $0.8<\lambda<1.2$ and the discharging speed Vp of the premixed fluid was in the range of $1.0\ m/s<Vp<2.0\ m/s$. The fuel and air supplied from the supplying tubes 31 and 32 to the space between the cylinders 23 and 24 are mixed while flowing in the space to create a uniform premixed fluid, by which the premixing flame burned with the high air ratio is formed in the nozzle 25. The fuel and air supplied from the supplying tubes 33 and 34 are mixed in the premixing chamber 35 to create a uniform premixed fluid, by which the laminar flow premixing flame is formed in the nozzle 27. In order to form the stable laminar flow premixing flame, the combustion condition was so selected that the air ratio $\lambda$ was in the range of $0.8<\lambda<1.2$ and the discharging speed Vp of the premixed fluid was in the range of $1.0\ m/s<Vp<2.0\ m/s$.

In the burner apparatus shown in FIGS. 4A and 4B, the reason why the nozzle 20 for forming the premixing flame burned with the low air ratio is arranged at the upstream side of the nozzle 25 for forming the premixing flame burned with the high air ratio is that, after the oxygen for forming the low air ratio flame is adequately consumed and the gas including a large amount of hot combustible gas is generated, the gas is to be mixed with the gas from the high air ratio flame. In this way, after the reducing agent such as $H_2$, CO and the like is adequately produced from the premixing flame with the low air ratio, by mixing such reducing agent with the NOx generated from the premixing flame with the high air ratio, it is possible to promote the reducing reaction, thereby decreasing the NOx. Further, as an improved burner apparatus obtained by improving the burner apparatus of FIGS. 4A and 4B, in order to promote the mixing between the NOx generated from the high air ratio flame and the reducing agent generated from the low air ratio flame, the premixed fluid for the high air ratio flame can be introduced as a swirl flow. Further, by introducing only the combustion air into the nozzle 6 of the burner apparatus shown in FIG. 1A, a so-called two-stage burning method wherein the non-burned combustibles generated from the low air ratio flame formed in the nozzle 2 are perfectly burned can be carried out. Furthermore, in such two-stage burning method, in order to achieve the perfect combustion in a smaller area, the combustion air from the nozzle 4 can be introduced as a swirl flow.

Figure 5A:
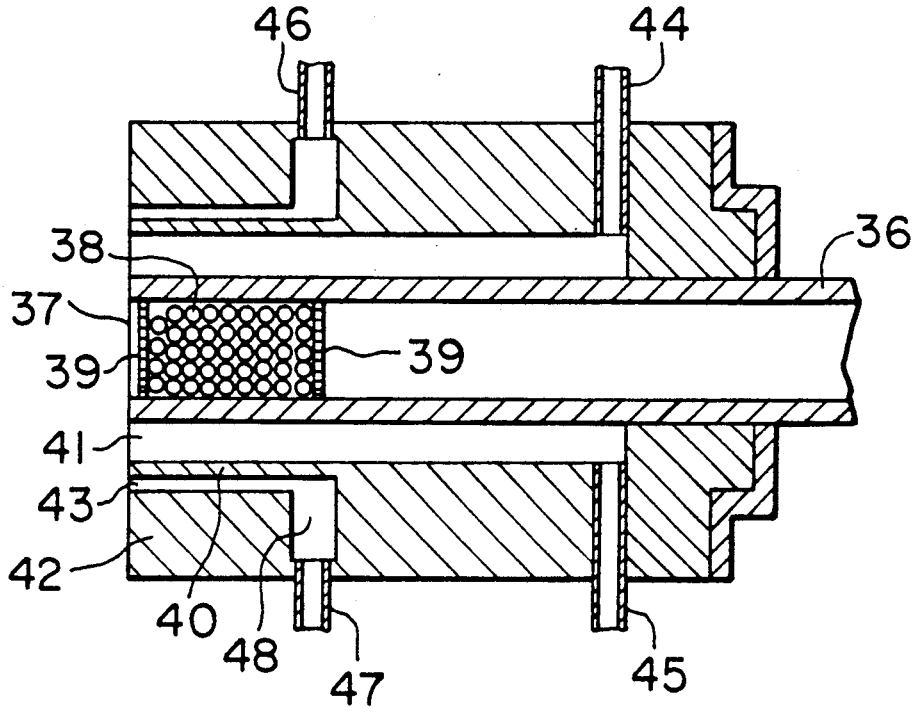
FIG. 5A is a longitudinal sectional view of a burner apparatus according to a further embodiment of the present invention.
Figure 5B:
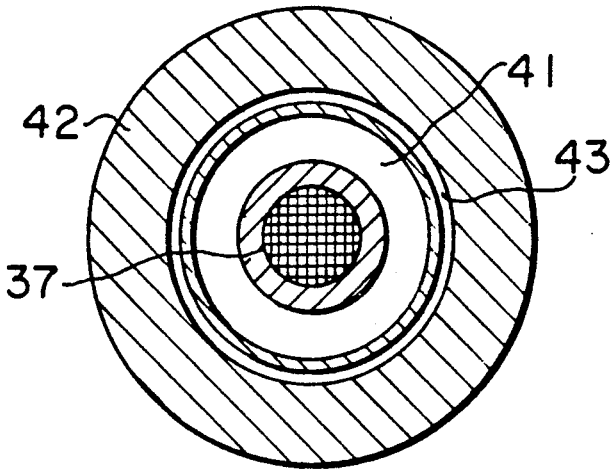
FIG. 5B is an end view of the burner apparatus of FIG. 5A.

In FIGS. 5A and 5B, a premixing nozzle 37 for forming the premixing flame with the low air ratio is constituted by a tip of a cylinder 36 through which the premixed fluid having the low air ratio flows. Combustion catalyst 38 is filled in the nozzle at an upstream portion thereof The combustion catalyst can be obtained by holding Pb metal with an amount of 1.0 wt % on La.$\beta$-.$Al_2O_3$ sintered material (as a porous carrier). Heat-resisting ceramic porous plates 39 are arranged on both sides of the catalyst layer 38 to hold the combustion catalyst 38 in position. A cylinder 40 is arranged around the cylinder 36 with a certain clearance, thus defining a nozzle 41 therebetween, which nozzle 41 is used for forming the premixing flame with the high air ratio. Further, a cylinder 42 is arranged around an outer periphery of the nozzle 41, thus defining a nozzle 43 for forming the laminar flow premixing flame. A fuel supplying tube 44 and an air supplying tube 45 are arranged at an upstream side of the nozzle 41. A premixing chamber 48 connected to a fuel supplying tube 46 and to an air supplying tube 47 is arranged at an upstream side of the nozzle 43.

The gaseous fuel and air supplied to the cylinder 36 are mixed together while flowing in the cylinder to create a uniform premixed fluid, which reacts on the combustion catalyst 38 to form the premixing flame burned with the low air ratio in the nozzle 37. The fuel and air supplied from the supplying tubes 44 and 45 into the space between the cylinders 36, 40 are mixed while flowing in the space to create a uniform premixed fluid, by which the premixing flame burned with the high air ratio is formed in the nozzle 41. The fuel and air supplied from the supplying tubes 46 and 47 are mixed together in the premixing chamber 48 to form a uniform premixed fluid, by which the laminar flow premixing flame is formed in the nozzle 43. In order to form the stable laminar flow premixing flame in the nozzle 43, the combustion condition was so selected that the air ratio $\lambda$ is in the range of $0.8<\lambda<1.2$ and the discharging speed Vp of the premixed fluid is in the range of 1.0 m/s$<$Vp$<$2.0 m/s.

In the burner apparatus shown in FIGS. 5A and 5B, the flame holding means due to the laminar flow premixing flame is not needed for forming the premixing flame burned with the low air ratio. Further, since the adequate reducing chemical species are generated at the outlet of the catalyst layer 30 positioned on the upstream side of the nozzle 37, it is not necessary to arrange the face of the nozzle for forming the premixing flame with the low air ratio at the upstream side of face of the nozzle for forming the premixing flame with the high air ratio in order to effectively reduce the NOx generated from the premixing flame with the high air ratio thereby decreasing the NOx, unlike the burner apparatus shown in FIGS. 4A and 4B.

Figure 6:
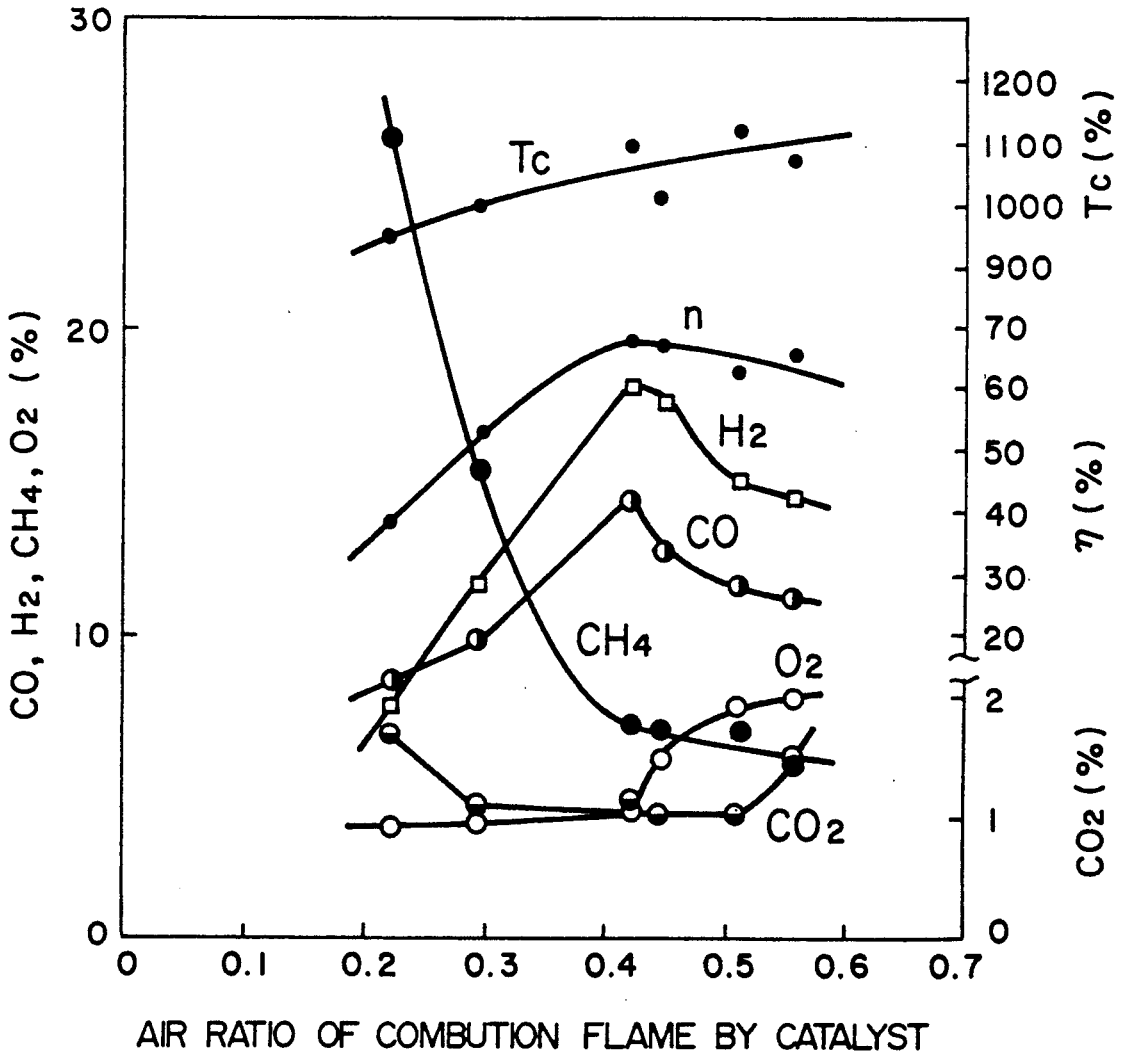
FIG. 6 is a graph showing a relation between an air ratio of the burner apparatus according to the present invention and amounts of $CO_2$, $O_2$, $CH_4$, CO, $H_2$, $\eta$ and Tc.

FIG. 6 shows a result of the test performed by using the burner apparatus of FIGS. 5A and 5B. Theordinate indicates an amount of the generated reducing substances CO, $H_2$, $CH_4$ picked up at the outlet of the catalyst layer, an amount of the generated $CO_2$, a temperature (Tc) of the catalyst layer, and softening degree ($\eta$), and the abscissa indicates the air ratio of the premixing flame burned with the low air ratio formed in the nozzle 37. The amounts of the reducing substances CO and $H_2$ will be maximum when the air ratio is 0.42 ($\lambda=0.42$). The residual amount of $CH_4$ is relatively great in the range of the air ratio $\lambda<0.42$, but is a little in the range of the air ratio $\lambda\geqq0.42$. The amount of the formed $CO_2$ is increased as the air ratio increases from 0.42. In this connection, the reason why the amounts of the generated reducing substances CO and $H_2$ are maximum in a low air ratio area having the air ratio $\lambda<1.0$ is considered that, as the air ratio $\lambda$ is decreased, the excessive fuel is supplied to worsen the combustion quality and to increase the amount of the residual $CH_4$ and to decrease the amount of the generated $H_2$ and CO, whereas, as the air ratio $\lambda$ is increased, a large amount of the combustion air is supplied to improve the combustion quality, thereby increasing the amount of the formed perfect combustion substance $CO_2$ and decreasing the amounts of the non-burned $H_2$ and CO. Since the temperature (Tc) of the catalyst layer increases above 100° C. when the air ratio $\lambda$ increases more than 0.3, in this embodiment of the present invention, it is preferable to use a heat resisting catalyst as the combustion catalyst.

A table 1 shows a result of the test of the low NOx burning method by using the burner apparatus shown in FIGS. 5A and 5B.

TABLE 1

| | Main Flame | | Catalyst Combustion | | | Composition of Exhaust Gas (%) | | | | | | NOx | Air Ratio |
|---|---|---|---|---|---|---|---|---|---|---|---|---|---|
| | Air | $CH_4$ | Air | $CH_4$ | NO gas | $H_2$ | CO | $CH_4$ | $O_2$ | $CO_2$ | $N_2$ | (ppm) | $\lambda$ |
| STEP.1 | 23.6 $\mu m^3/h$ | 1.57 $\mu m^3/h$ | 5.0 $\mu m^3/h$ | | 0.81 Nl/min | 0 | 0 | 0 | 8.8 | | 83.8 | 113 | 1.71 |
| STEP.2 | 23.6 $\mu m^3/h$ | 1.57 $\mu m^3/h$ | 5.0 $\mu m^3/h$ | 1.10 $\mu m^3/h$ | | 0.90 | 1.23 | 0 | 1.44 | | 82.9 | 19 | 1.02 |
| STEP.3 | 23.6 $\mu m^3/h$ | 1.57 $\mu m^3/h$ | 5.0 $\mu m^3/h$ | 1.10 $\mu m^3/h$ | 0.81 Nl/min | 1.07 | 1.41 | 0 | 1.92 | | 83.5 | 73 | 1.03 |
| EXIT OF CATALYST LAYER | 23.6 $\mu m^3/h$ | 1.57 $\mu m^3/h$ | 5.0 $\mu m^3/h$ | 1.10 $\mu m^3/h$ | | 15.3 | 13.7 | 3.6 | 3.4 | 2.2 | 64.0 | | 0.53 |

The method of the test will be explained. In a STEP.1, the premixing combustion air of 5.0 $Nm^3/h$ is introduced in the cylinder 36 and the premixing combustion air of 23.6 $Nm^3/h$ is introduced in the supplying tube 45 in a condition that the laminar flow premixing flame is formed in the nozzle 43 of the burner apparatus of FIGS. 5A and 5B. Next, the gaseous fuel of 1.10 $Nm^3/h$ is introduced into the supplying tube 44, thus forming the premixing flame with the high air ratio. Since the density of the NOx in the exhaust gas in this point is considerably low such as 5 ppm, by further introducing the 10%-NO gas ($N_2$ balance) of 0.81 Nl/min in the supplying tube 44, the density of the NOx in the exhaust gas is set to have a value of 113 ppm. Then, the exhaust gas is picked and the composition of the exhaust gas is analyzed.

In STEP.2, the supply of the 10%-NO gas (performed in the STEP.1) is stopped, and the gaseous fuel of 1.10 $m^3/h$ is introduced into the supplying tube 36. Then, the density of the NOx in the exhaust gas and the composition of the exhaust gas are analyzed, when the premixing flame with the low air ratio is formed in the nozzle 37 and the premixing flame with the high air ratio is formed in the nozzle 41.

In STEP.3, the density of the NOx in the exhaust gas and the composition of the exhaust gas are analyzed, when the 10%-NO gas of 0.81 Nl/min is supplied in STEP.2.

The reduction (decrease) ratio $\eta$ of the NOx was sought from the following equations on the basis of the result of the analyses of the exhaust gas obtained in the STEP.1 to STEP.3:

$$\text{Reference NOx} = \text{NOx(STEP. 1)} \times \frac{N_2(\text{STEP.3})}{N_2(\text{STEP.1})} + \text{NOx(STEP.2)} \times \frac{N_2(\text{STEP.3})}{N_2(\text{STEP.2})} \quad (1)$$

Here, NOx(STEPS.1 to 3) is the density (ppm) of the NOx in the exhaust gas in each STEP, and $N_2$(STEPS.1 to 3) is the density (%) of the NOx in the exhaust gas in each STEP.

$$\text{Reduction ratio } \eta \text{ of NOx} = \frac{\text{Reference NOx} - \text{NOx (STEP.3)}}{\text{Reference NOx}} \times 100 \quad (2)$$

Figure 7:
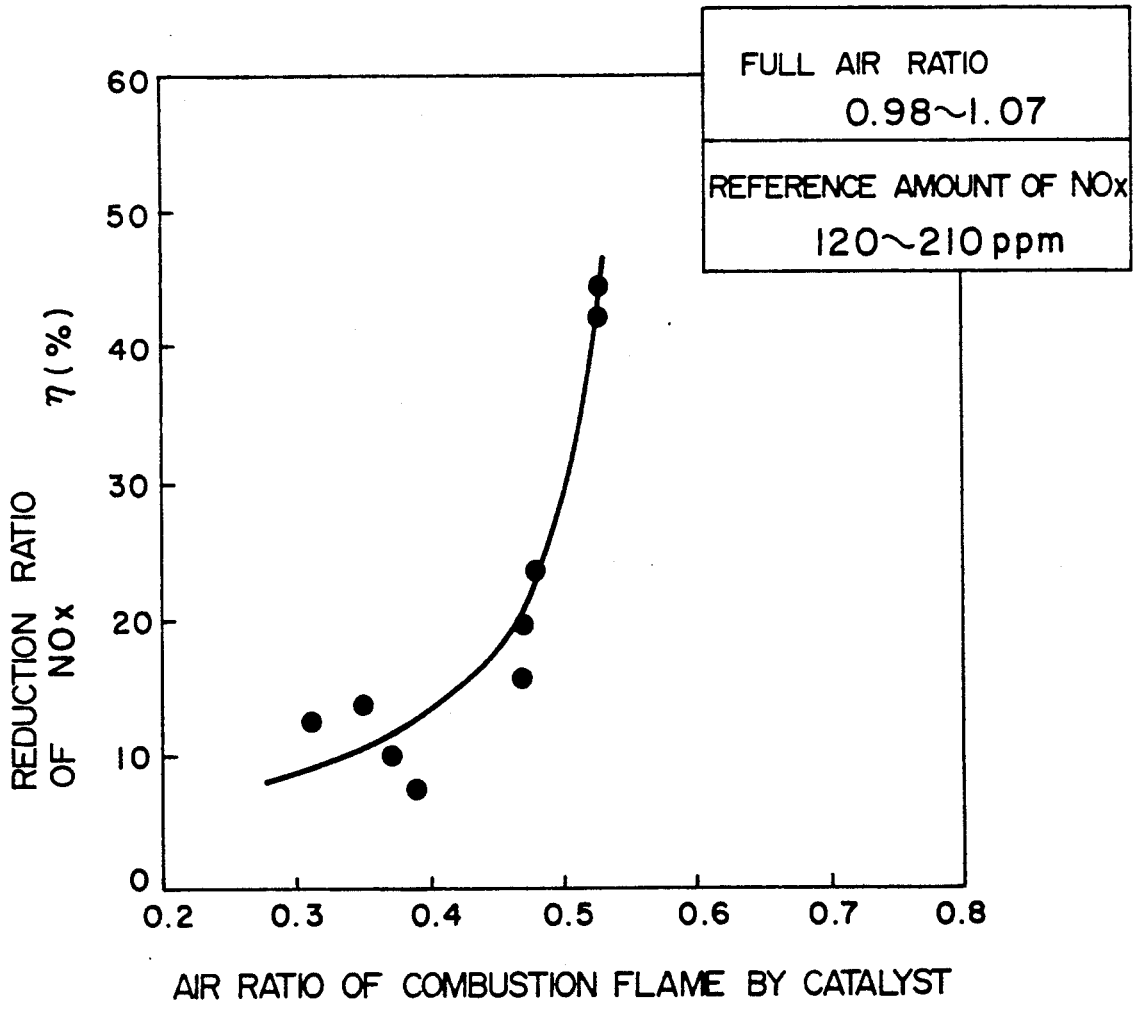
FIG. 7 is a graph showing a relation between the air ratio and a reduction ratio of NOx.

FIG. 7 shows a result of the low NOx burning test performed by using the burner apparatus of FIGS. 5A and 5B. The ordinate indicates the NOx reduction ratio ($\eta$) calculated from the above equations (1) and (2), and the abscissa indicates the air ratio of the premixing flame with the low air ratio formed in the nozzle 37. As the combustion conditions, the full air ratio $\lambda$ of the exhaust gas is in the range of $0.98 \leqq \lambda \leqq 1.07$, and the value of the reference NOx calculated from the above equation (1) is 120 to 210 ppm. As seen from FIG. 7, in the range of $0.30 \leqq \lambda \leqq 0.55$, the NOx reduction ratio $\eta$ increases as the air ratio $\lambda$ increases, and the NOx reduction ration $\eta$ reaches up to 45% when the air ratio is 0.52 ($\lambda = 0.52$). As a result, it is found that the NOx generated from the nozzle 41 of FIG. 5A is effectively reduced and decreased by the reducing chemical species generated from the nozzle 37.

A table 2 shows a result of the test for examining how much that NOx is decreased when the load of the high air ratio flame formed in the nozzle 41 of FIG. 5A is increased in the range of 72% to 79% and the density of the NOx generated from the high air ratio flame is increased up to 70 ppm to 90 ppm as STEP.1, and in this case the low air ratio flame is formed in the nozzle 37 as STEP.2. The reduction ratio $\eta$ of the NOx was calculated from the following equations, on the basis of the result of the analyses of the exhaust gas obtained in STEP.1 and STEP.2.

$$\text{Reference NOx} = \text{NOx(STEP. 1)} \times \frac{N_2(\text{STEP.2})}{N_2(\text{STEP.1})} \quad (3)$$

Here, NOx(STEPS.1, 2) is the density (ppm) of the NOx in the exhaust gas in each STEP, and $N_2$(STEPS. 1, 2) is the density (%) of the NOx in the exhaust gas in each STEP.

TABLE 2

| | STEP | | | | | | | | | | | |
|---|---|---|---|---|---|---|---|---|---|---|---|---|
| | 1 | | | | | | 2 | | | | | |
| | High air Ratio Flame | | | Low Air Ratio Flame | | | High Air Ratio Flame + Low Air Ratio Flame | | | | | |
| RUN | $F_{CH4,1}$ ($Nm^3/n$) | $\lambda_1$ | $NOx_{,1}$ (ppm) | $F_{CH4,2}$ ($Nm^3/h$) | $\lambda_2$ | $NOx_{,2}$ (ppm) | $\lambda_2$ | $NOx_{,t}$ (ppm) | $\eta$ (%) | $O_2$ (%) | CO (%) | $H_2$ (%) |
| 1 | 2.22 | 1.12 | 73.7 | 0.88 | 0.63 | 0 | 0.98 | 35.0 | 52.5 | 1.9 | 2.5 | 2.1 |
| 2 | 2.44 | 1.02 | 91.2 | 0.66 | 0.72 | 0 | 1.00 | 53.0 | 41.9 | 1.4 | 1.5 | 1.4 |

$$\text{Reduction ratio } \eta \text{ of NOx} = \frac{\text{Reference NOx} - \text{NOx (STEP.2)}}{\text{Reference NOx}} \quad (4)$$

In the Table 2, the reduction ratio $\eta$ of the NOx reaches 52.5% when the air ratio $\lambda$ of the low air ratio flame is 0.63 in RUN.1, and the reduction ratio $\eta$ of the NOx reaches 41.9% when the air ratio $\lambda$ of the low air ratio flame is 0.63 in RUN.2. As a result, it is found that the NOx generated from the high air ratio flame formed in the nozzle 41 of FIG. 5A is effectively reduced and decreased by the reducing chemical species generated from the nozzle 37.

Figure 8:
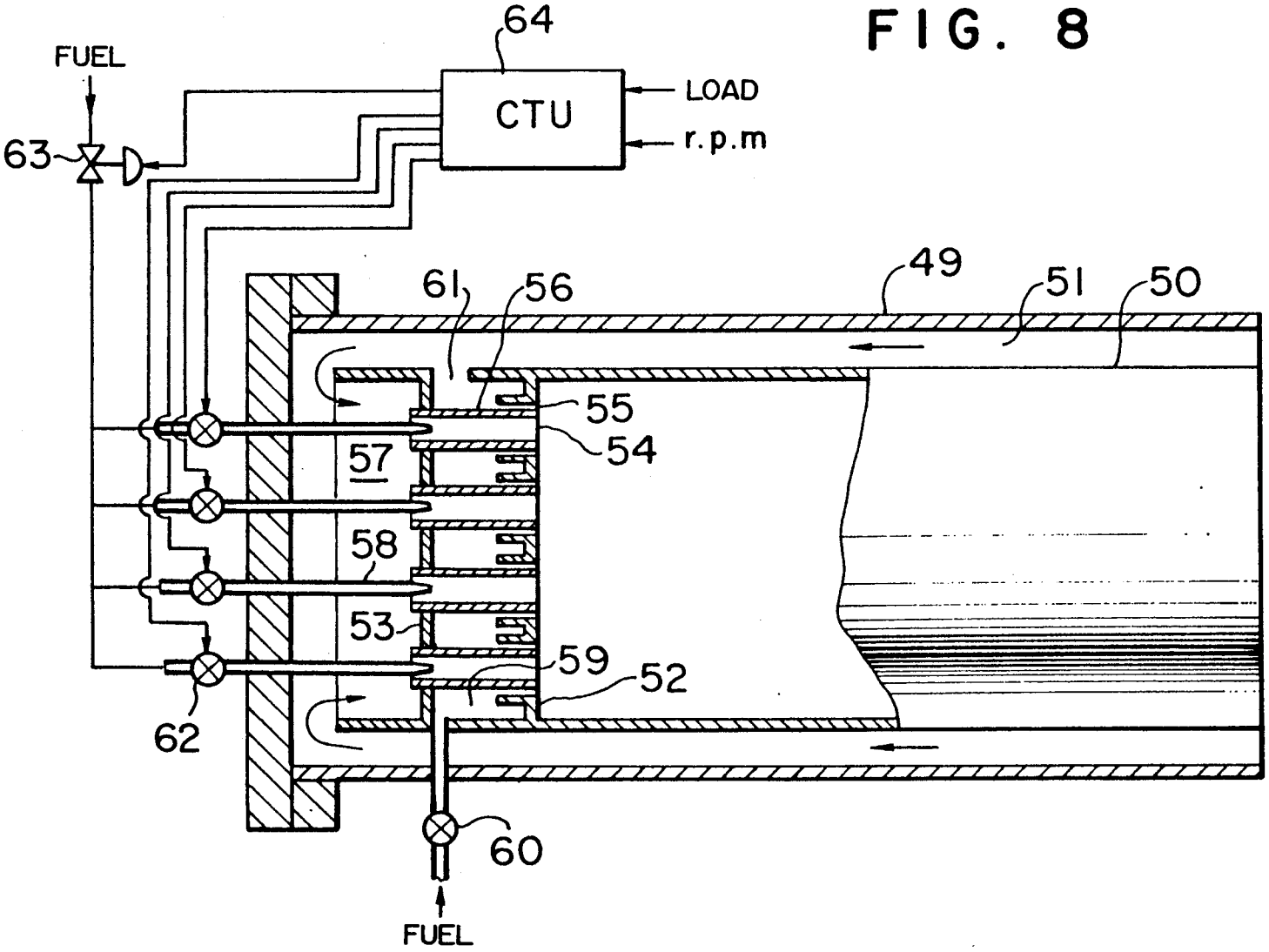
FIG. 8 is a longitudinal sectional view of a burner apparatus according to a further embodiment of the present invention.

In FIG. 8, and inner cylinder 50 is arranged within an outer cylinder 49 in coaxial with the latter to form an annular space therebetween. The annular space constitutes an air passage 51 for directing air discharged from a compressor (not shown) to a head of the inner cylinder 50. On the head of the inner cylinder 50, there are arranged dual end walls 52 and 53, one of which is the inner end wall 52 to which main nozzles 54 for forming a high air ratio flame and a low air ratio flame on substantially the whole areas thereof and auxiliary nozzles 55 for forming a laminar flow premixing flame enclosing the flames from the main nozzles are opened, as shown in FIG. 8. The main nozzle 54 is formed at a right end of a corresponding premixing cylinder 56 extending through the outer end wall 53. Air from an air chamber 57 formed on the left side of the outer wall 53 is introduced into the premixing cylinders 56 from left ends thereof Fuel supplying tubes 58 are inserted into the corresponding premixing cylinders 56, and the fuel discharged from each fuel supplying tube 58 is mixed with air while flowing in the corresponding premixing cylinder to form premixed fluid. The auxiliary nozzles 55 communicate with an auxiliary premixing chamber 59 formed between the end walls 52 and 53. The chamber 59 is supplied with auxiliary fuel through an auxiliary fuel regulator valve 60, which auxiliary fuel is mixed with air from an air opening 61 formed in a peripheral wall of the inner cylinder 50 to form a premixing fluid. The fuel supplying tubes 58 are connected to a main fuel regulator valve 63 through corresponding stop valves 62. The valves 62 and 63 are controlled by command from a controller 64. The controller 64 receives signals regarding the load and rotational speed of the gas turbine.

Each stop valve 62 is fully opened when it receives an "open" signal from the controller 64, and, in all other cases, the stop valves are closed. In FIG. 8, although only four stop valves are shown, it should be noted that such stop valves are provided for all of the fuel supplying tubes. In the illustrated embodiment, nineteen stop valves are provided, and the number of valves to be opened increases as the load of the turbine increases. On the other hand, the opening of the regulator valve 63 increases substantially in proportion to the increase of the turbine load. The regulator valve 60 has a constant or given opening (about 10%), regardless of the turbine load A substantially given amount of fuel is supplied to the auxiliary premixing chamber 59 through the regulator valve 60, and the mixing rate between the fuel and the air sent through the air opening 61 is set to have a value in the range of the air ratio 0.8 to 1.2. The discharging speed of the premixed fluid from the auxiliary nozzle 55 is adjusted to have a value of 1.2 to 2.0 m/s larger than the combustion speed (0.5 m/s).

When the gas turbine is operated, first of all, the regulator valve 60 is opened (the opening thereof is about 10%) to introduce the fuel into the auxiliary premixing chamber 59, as well as the air from the air opening 61, thus forming the premixed fluid in the chamber. Then, the premixed fluid discharged from the auxiliary nozzles 55 is ignited by ignition plugs (not shown). Since the air ratio of the premixed fluid is set to about 1, preferably 0.8 to 1.2 and the discharging speed of the premixed fluid is 1.0 to 2.0 m/s, the ignition is positively effected and the fluid is burned stably after the ignition.

In this point, since almost of the stop valves 62 are closed, only the air is discharged from the main nozzles 54. When the opening of the regulator valve 63 gradually increases in response to the signal regarding the turbine load, the stop valves 62 are successively opened in a predetermined order As a result, the premixed fluid having a predetermined air ratio are formed in the premixing cylinders 56, which premixed fluid are discharged from the corresponding main nozzles 54 at a high speed. The premixed fluids discharged from the main nozzles 54 are ignited and then held by the surrounding auxiliary flame, thus forming main flames. As the stop valves are successively opened, the number of the flames formed in the main nozzles 54 increases successively. At last, the low air ratio flame and the high air ratio flame are simultaneously formed in all of the main nozzles 54 when the turbine reaches its rated load. In this point, in order to effectively reduce the NOx generated from the high air ratio flame and decrease the NOx the load of the low air ratio flame is set to 25% and the air ratio is set to have a value of 0.5 to 0.8. Generally in the power generation gas turbine, since the speed of rotation of the turbine is constant during the turbine load of 0% to 100%, the amount of air supplied to the burner apparatus is substantially constant. Accordingly, the amount of air flowing from the air chamber 57 into the premixing cylinders 56 is also substantially constant.

On the other hand, the amount of fuel passing through the regulator valve 63 varies substantially in proportion to the turbine load; when the turbine load is smaller than 25%, the regulator valve 63 and the stop valves 62 are adjusted so that the air ratio of the premixed fluid formed in the premixing cylinders 56 has a value of 0.5 to 0.8. When the turbine load is in the range of 25% to 100%, the low air ratio flame corresponding to the turbine load of 25% is formed in the range of the air ratio $0.5<\lambda<0.8$ and, at the same time, the high air ratio flame is formed by introducing the fuel into other premixing cylinders 56, thus increasing the load.

In the illustrated embodiment, since the premixed fluid in the auxiliary nozzles 55 is set to have the air ratio of 1 or thereabout to effectively hold the flame, even when the premixed fluid is discharged from the main nozzles 54 at high speed, the auxiliary flames formed in the auxiliary nozzles are not put out, and the high air ratio flame and low air ratio flame formed in the main nozzles 54 can be stably burned by the flame holding due to the auxiliary flames.

Figure 9:
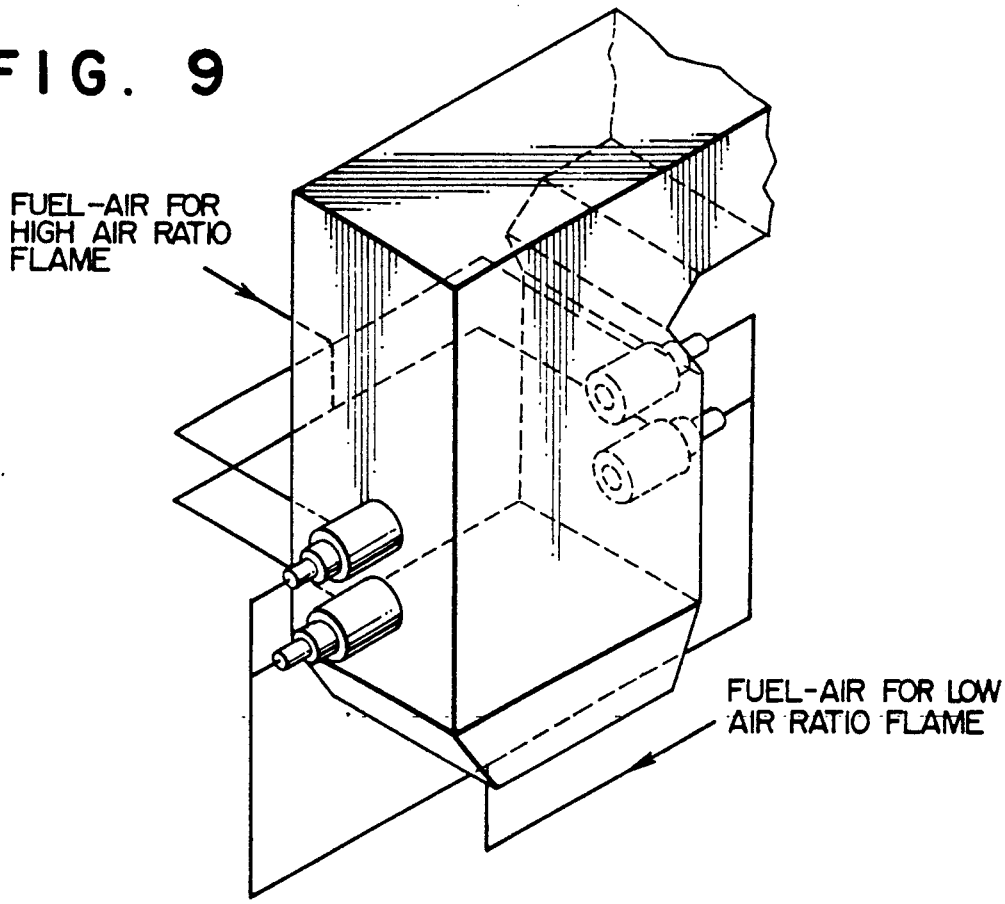
FIGS. 9 and 10 are perspective views of boilers incorporating the burner apparatus according to the present invention.

FIG. 9 shows an example of a boiler having a plurality of burners for forming the high air ratio flame and low air ratio flame in the same flame, as shown in FIG. 1A, 4A or 5A. In this embodiment, the distribution of the gaseous fuel to be supplied was so adjusted that the fuel used for forming the premixing flame burned with the high air ratio was 60%, the fuel used for forming the premixing flame burned with the low air ratio was 35%, and the fuel used for forming the laminar flow premixing flame for holding the high and low air ratio flames was 5%, in order to adequately reduce the generated NOx by means of the reducing agent generated from the low air ratio flame. As judged from the fundamental test result of the low NOx burning method shown in FIG. 7 and the table 2, the air ratio of the low air ratio flame was selected to have a value of 0.55 to 0.70 to improve the reduction ratio $\eta$ of the NOx. Further, in order to improve the combustion efficiency, the fuel and air to be supplied were adjusted so that the full air ratio was 1.0 to 1.1. In this embodiment, the density of the NOx in the exhaust gas can be decreased less than 5%.

Figure 10:
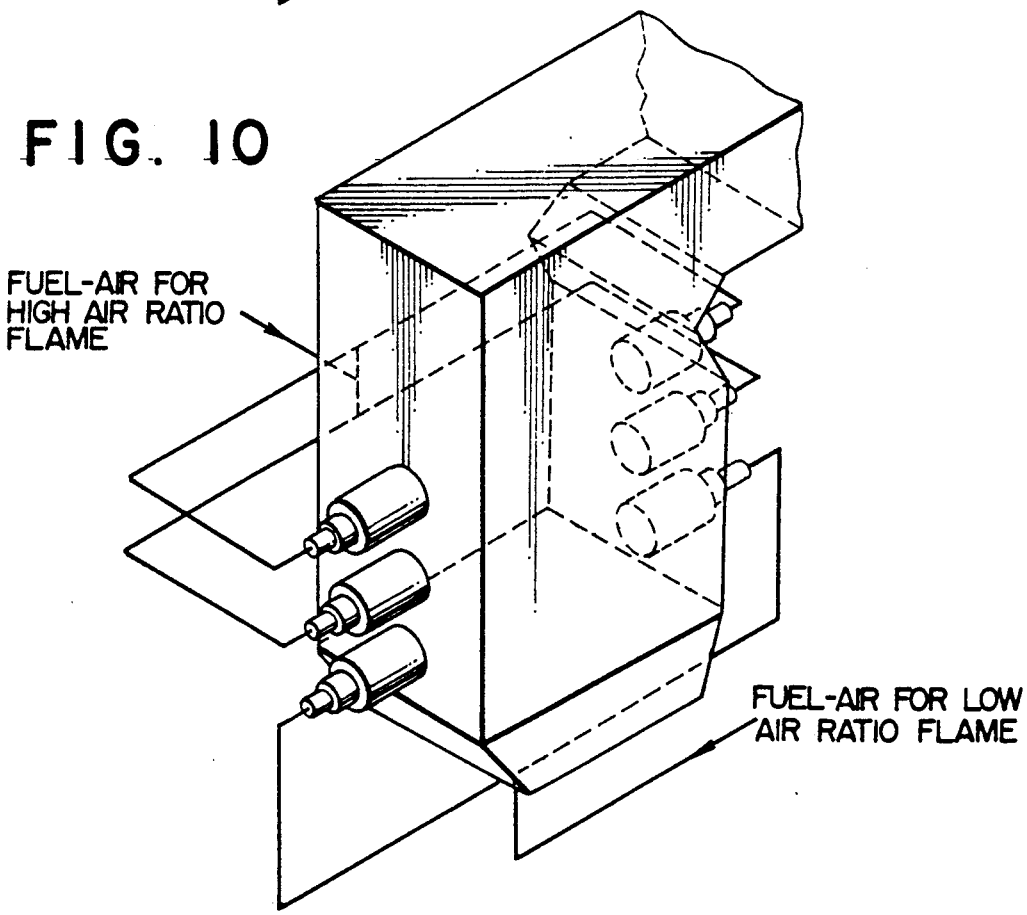

FIG. 10 shows an example of a boiler which can reduce the generated NOx and decrease the NOx by forming the premixing flame with the high air ratio at a trailing stream side of the premixing flame with the low air ratio.

Figure 11A:
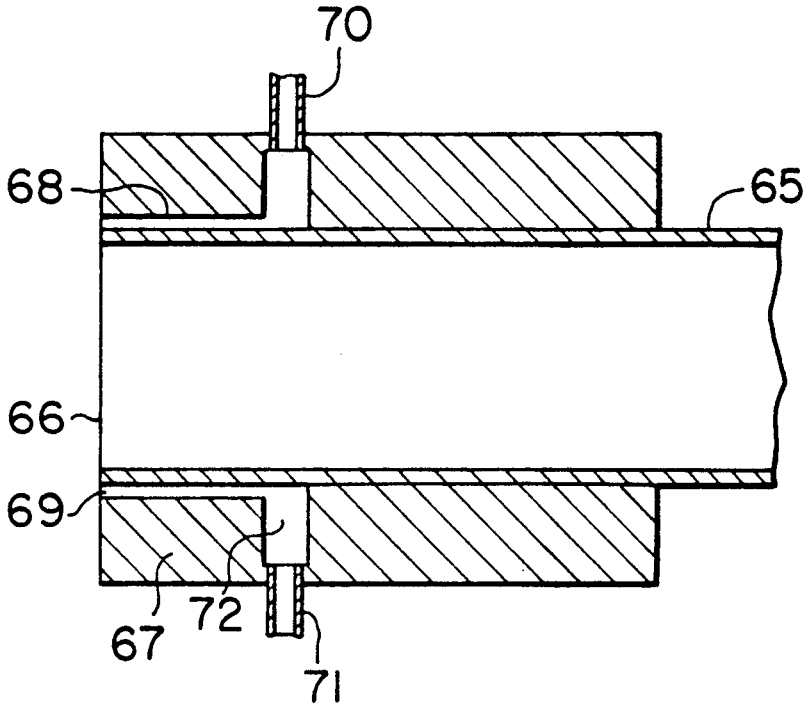
FIG. 11A is a longitudinal sectional view of a burner apparatus according to a further embodiment of the present invention.
Figure 11B:
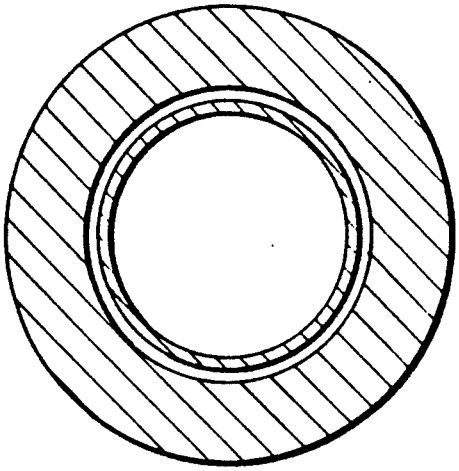
FIG. 11B is an end view of the burner apparatus of FIG. 11A.

FIGS. 11A and 11B show a burner used with the boiler of FIG. 10. A cylinder 65 is used as a nozzle 66 for forming the premixing flame burned with the high air ratio or with low air ratio. An annular flow passage 68 defined between the cylinder 65 and a cylinder 67 and positioned around the nozzle 66 is used as a nozzle 69 for forming the laminar flow premixing flame. A premixing chamber 72 connected to a fuel supplying tube 70 and to an air supplying tube 72 is arranged at an upstream side of the nozzle 69.

The gaseous fuel and air supplied to the cylinder 65 are mixed together while flowing in the cylinder to form a uniform premixed fluid, by which the premixing flame burned with the high air ratio or with the low air ratio is formed in the nozzle 66. The fuel and air supplied from the supplying tubes 70 and 71 are mixed in the premixing chamber 72 to form a uniform premixed fluid, by which the laminar flow premixing flame is formed in the nozzle 69.

FIG. 10 shows the boiler using the burner of the boiler of FIG. 9, wherein the low air ratio flame is formed in a first stage, and the high air ratio flame is formed at the trailing stream side of the low air ratio flame, spaced apart from the latter by a predetermined distance. In the burning method using this boiler, the high air ratio flame is formed after the low air ratio flame at the first stage is completely burned up to generate the reducing agent adequately, and the NOx generated from the high air ratio flame is mixed with the reducing agent generated from the low air ratio flame to effectively decrease the NOx and to burn the non-burned combustibles from the low air ratio flame perfectly. The distribution of the fuel was so selected that the fuel used for forming the high air ratio flame was 60%, the fuel used for forming the low air ratio flame was 35%, and the fuel used for forming the laminar flow premixing flame for holding the flames was 5%. Further, the air ratio of the low air ratio flame was selected to have a value of 0.55 to 0.70 to improve the reduction ratio $\eta$ of the NOx, and the fuel and air to be supplied were adjusted so that the full air ratio was 1.0 to 1.1, in order to improve the combustion efficiency.

Figure 12:
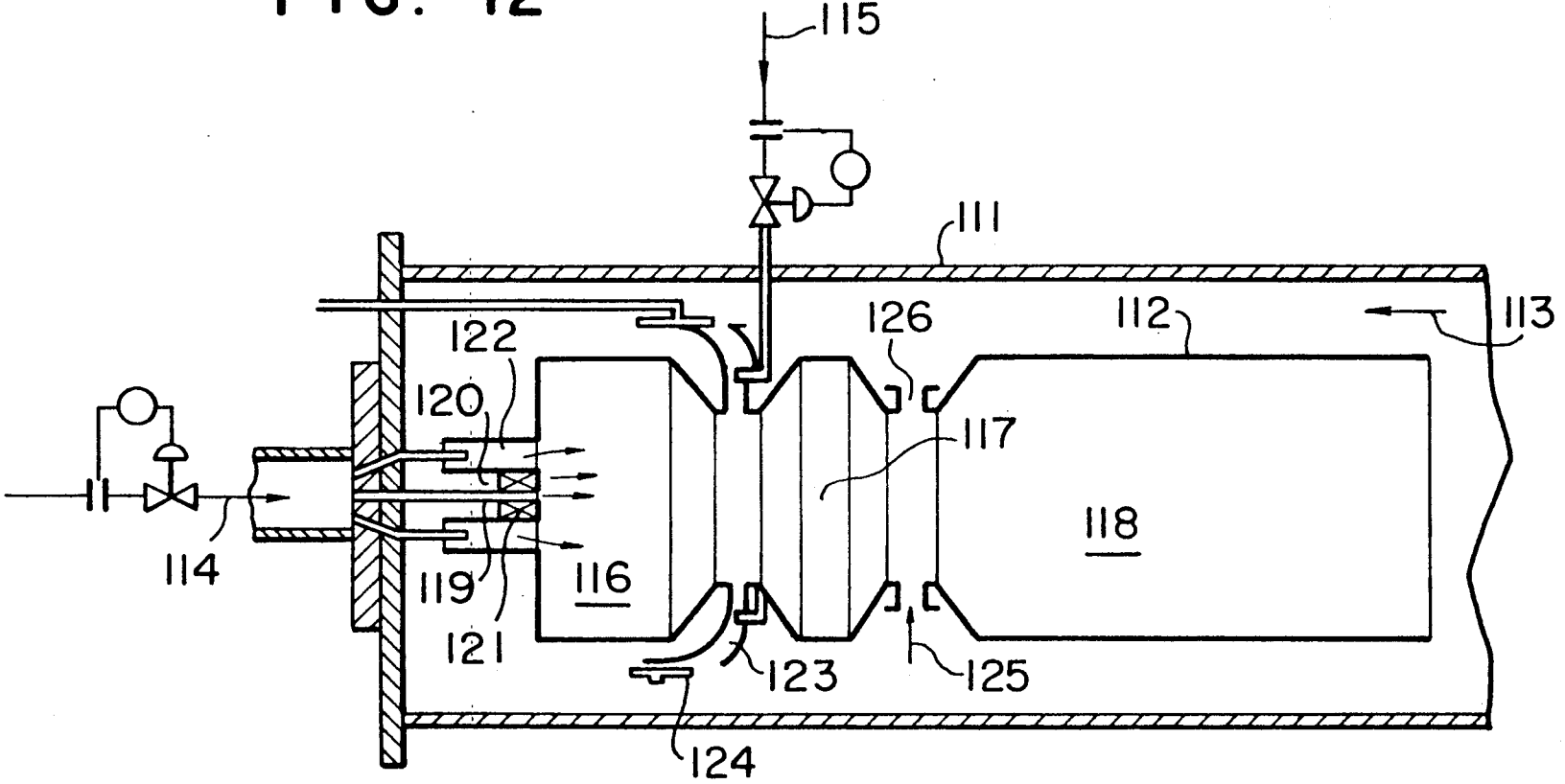
FIG. 12 is a longitudinal sectional view of a burner apparatus according to a further embodiment of the present invention.

In FIG. 12, a burner apparatus comprises an outer cylinder 111 and an inner cylinder 112 for the burner. A space defined between the outer cylinder 111 and the inner cylinder 112 is used as a flow passage for combustion air 113 supplied from an air compressor (not shown). Within the inner cylinder 112, there is arranged a combustion chamber where the fuel is burned with air. The fuel to be supplied to the combustion chamber is introduced at two stages. Primary fuel 114 is introduced from the end of the inner cylinder 112 of the burner and secondary fuel is introduced in the combustion chamber on the way of the inner cylinder 112. The combustion chamber is constituted by a primary burning area 116 to which the primary fuel 114 and air are supplied, a secondary burning area 117, and a perfect combustion area 118. Further, two restrictions are provided in the inner cylinder 112. The secondary fuel 115 and the combustion air are introduced into the inner cylinder from the first restriction through a secondary fuel jet nozzle 123, and the air 125 for the perfect combustion is introduced into the inner cylinder from the second restriction through a perfect combustion air nozzle 126. The fuel to be burned in the primary burning area 116 is supplied from a plurality of burners, and a part of the fuel is discharged from a burner arranged on a center line of the combustion chamber. In this burner, the fuel and the air are discharged from a fuel nozzle 119 for the diffusive flame and an air nozzle 120 for the diffusive flame, respectively, so that the fuel and the air are mixed in the combustion chamber to form the diffusive flame. Further, in this burner, a swirl flow generator 121 for introducing the combustion air as a swirl flow is arranged in the air nozzle 120 for the diffusive flame, in order to stable the flame. A plurality of premixing burners 122 are arranged around the aforementioned burner, and the fuel and air discharged from these burners are mixed in the burners and then the introduced into the combustion chamber.

The secondary fuel 115 is mixed with the combustion air in response to the load and is introduced from the first restriction into the combustion chamber. The secondary fuel 115 is mixed with the combustion air in the secondary fuel jet nozzle 123 and thereafter is introduced into the combustion chamber. Here, the flow rate of the air to be introduced is adjusted by a flow rate regulator 124 arranged in the air inlet. The discharged fuel is burned with the residual air or introduced air (introduced simultaneously with the fuel) in the primary burning area.

In this burner apparatus, the primary fuel 114 is used as the main fuel and the secondary fuel 115 is used to generate the reducing atmosphere. Accordingly, only the primary fuel 114 is used at the start of the gas turbine and in the operation f the turbine with a low load, and, as the turbine load increases, the secondary fuel 115 is introduced. During the relatively low turbine load, when the secondary fuel 115 is introduced, since the air ratio in the primary burning area 116 is high and a large amount of oxygen remains in this area, the secondary fuel 115 is introduced without mixing with the air. When the turbine load increases, since the air ratio in the primary burning area 116 decreases, the secondary fuel 115 is introduced with mixing with the air.

In the primary burning area 116 separated from the secondary burning area 117 by the first restriction, since almost all parts of the flame is premixing flame, the length of the flame is short. Further, in this burner apparatus, the diffusive flame which can easily form the stable flame in the center is used, the premixing flame is ignited by the diffusive flame and can be stably burned. Further, the secondary fuel 115 is used for reducing the NOx formed in the primary burning area 116. In order to reduce the NOx, it is necessary that the density of oxygen is low and a large amount of gaseous combustibles exists in the secondary burning area 117. To this end, the air ratio in the primary burning area 116 is selected to have a value in the order of 0.8 to 1.4 and the air ratio in the secondary burning area 117 is selected to have a value in the order of 0.5 to 1.0.

Figure 13:
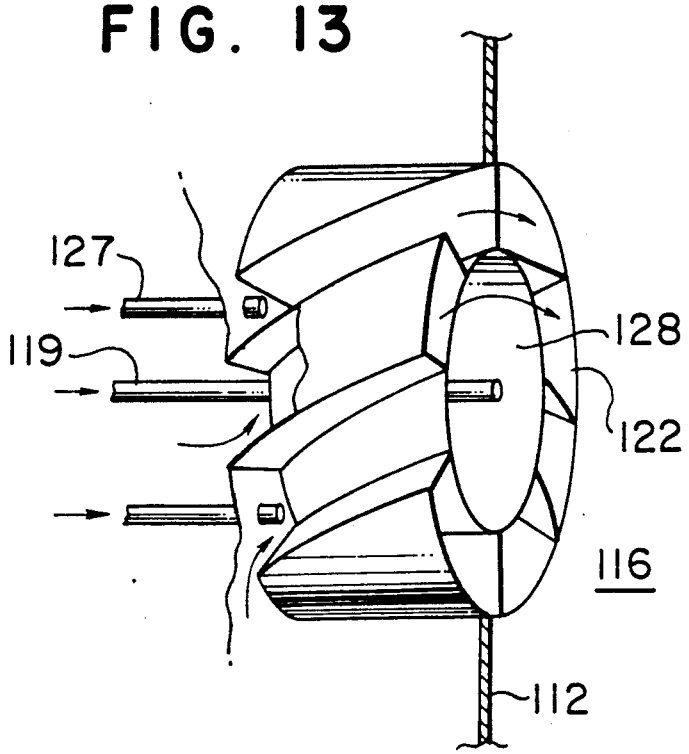
FIG. 13 is a partial perspective view of a burner apparatus according to a further embodiment of the present invention.

In FIG. 13, the construction of the burner for forming the primary burning area 116 is shown. In this burner construction, a diffusive flame forming burner 128 is provided for forming the diffusive flame in the center. Burners 122 for forming the premixing flame are arranged around the burner 128. The premixed fuel-air mixture discharged from each burner 122 is directed in a direction tangential to a certain circle. With the burner apparatus so constructed, since the central diffusive flame is used for igniting the premixed fluid, it is possible to improve the ignition stability of the premixed fluid discharged from the periphery of the diffusive flame. Further, since each of the premixed fluids is discharged as a swirl flow, the negative pressure is created in the central portion of the burner apparatus, whereby the peripheral premixed fluids flow toward the central portion, thus shortening the length of the diffusive flame and improving the stability of the flame.

Figure 14:
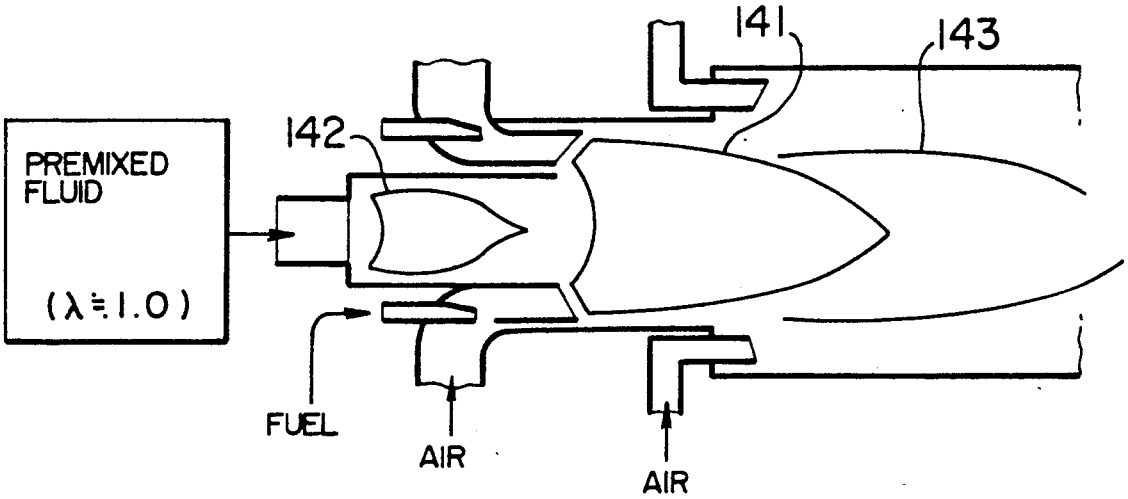
FIG. 14 is a schematic sectional view showing flames generated by the burner apparatus of FIG. 12.

Only the fuel may be discharged from the central portion of the burner apparatus In this case, the air ratio of each of the premixed fluids discharged from the periphery is set to have a value more than 1, and the fuel is burned with the oxygen remained in the premixing flames. If only the fuel is discharged from the central portion of the burner apparatus, even when the ignition of the premixed fluid is unstable, since the oxygen in the premixed fluids is used for burning the fuel discharged from the central portion, the flame can be formed in the central portion, and then the premixed fluids can be ignited by this central flame. As shown in FIG. 14, the low air ratio flame 141 is held or maintained by the premixing flame 142 burned with the air amount near the theoretical air amount, thus forming the reducing flame including the combustibles having substantially no oxygen. The reducing flame is added by the air at the trailing stream thereof, thus creating the perfect combustion flame 143.

Figure 15:
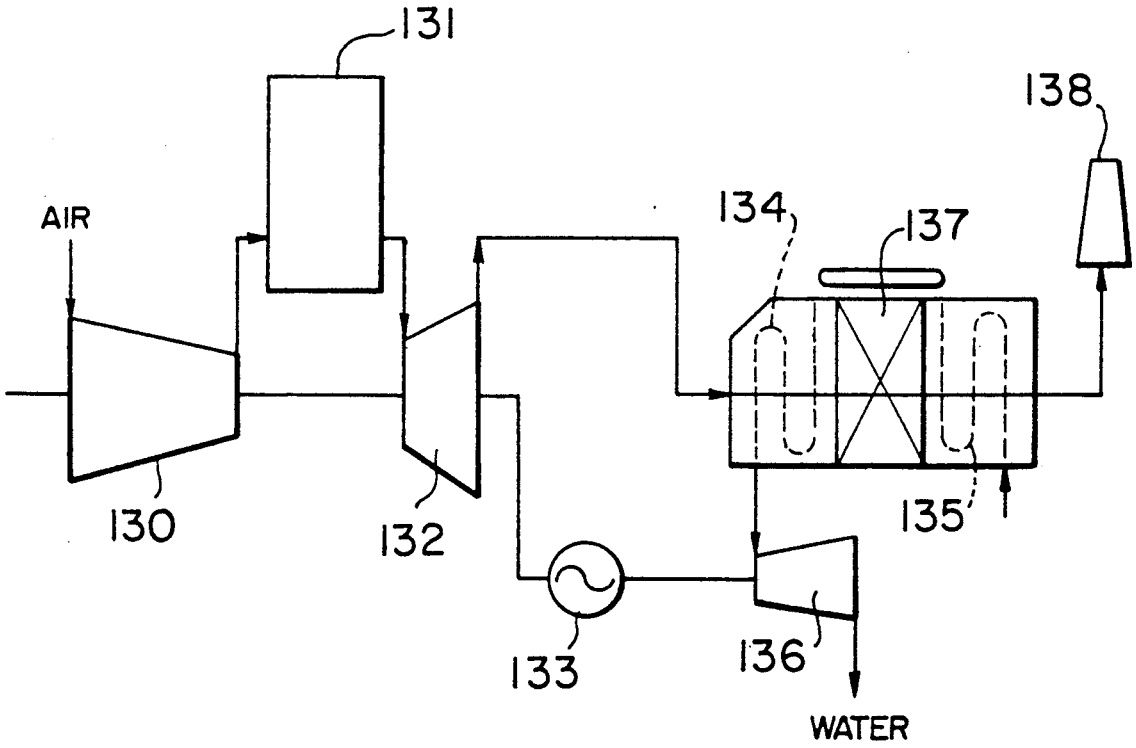
FIG. 15 is a schematic constructional view of a combined power plant wherein the burner apparatus of FIG. 1 is used with a gas turbine.

In FIG. 15, the air is compressed by a compressor 130 and then is supplied to a burner apparatus 131. A hot gas discharged from the burner apparatus 131 rotates a gas turbine 132, and, accordingly, rotates a generator 133 connected to the gas turbine, thus generating the electric power. A hot exhaust gas discharged from the gas turbine 132 enters into a boiler 134, where steam is generated by a heat transfer tube 135 arranged in the boiler. The steam rotates a steam turbine 136 as well as the generator 133, thus contributing to the generation of the electric power. The NOx generated from the burner apparatus decreases less than about 60%, and further decreases less than about 15% by using a denitrification device 137. The exhaust gas is ejected from a chimney 138.

According to the present invention, since the laminar flow premixing flame is formed on the roots of the premixing flames burned with the high air ratio and with the low air ratio which are the main flames, after the high air ratio flame and the low air ratio flame are adequately burned, the NOx generated from the high air ratio flame can be mixed with the reducing agent generated from the low air ratio flame. Therefore, the NOx generated from the high air ratio flame can be effectively reduced by the reducing agent adequately generated from the low air ratio flame, thus decreasing the NOx. In the present invention, it was found that the reduction ratio $\eta$ of the NOx reached 45% at the most. Further, since the premixing burning method is effective to shorten the flame length, by realizing the perfect premixing combustion by the present invention, it is possible to make the burning system such as the gas turbine, boiler and the like compact.

What is claimed is:

1. In a low NOx burning method wherein a low air ratio flame burned with an amount of air less than an amount of air in a theoretical air ratio required for burning fuel perfectly is formed, and combustibles discharged from said low air ratio flame are burned at a training stream of said low air ratio flame while supplying air, the improvement wherein:

said low air ratio flame is a premixing flame burned by premixing said fuel and air, and combustion of said premixing flame is maintained in a vicinity of said premixing flame by a flame burned around an outer periphery of said low air ratio flame, said last mentioned flame being a premixing flame burned by premixing the fuel and the air having substantially the theoretical air ratio required for substantially perfect combustion.

2. A low NOx burning method according to claim 1, wherein said means for maintaining the combustion of said premixing flame comprises a flame burned around an outer periphery of said low air ratio flame, said flame being a premixing flame burned by premixing the fuel and the air having substantially the theoretical air ratio required for substantial perfect combustion.

3. A low NOx burning method according to claim 1, wherein said flame for maintaining the combustion of said premixing flame is burned by using a catalyst.

4. A low NOx burning method according to claim 1, wherein said flame for maintaining the combustion of said premixing flame is burned ahead of said low air ratio flame.

5. A low NOx burning method according to one of claims 3 or 4, wherein a plurality of low air ratio flames are provided and correspond in number to a number of flames for maintaining combustion of said low air ratio flame.

6. In a low NOx burning method wherein a high air ratio flame burned with an amount of air more than the theoretical air amount required for perfect combustion is formed coaxial with a low air ratio flame burned with an amount of air less than said theoretical air amount, the improvement comprising:

forming a flame substantially completing combustion of said low air ratio flame and including combustibles substantially containing no oxygen, and burning said combustibles with said high air ratio flame, wherein both said low air ratio flame and said high air ratio flame comprise premixing flames burned by premixing the fuel and air.

7. A low NOx burning method according to claim 6, wherein the flame substantially completing combustion is a premixing flame burned about an outer periphery of said low air ratio flame and an inner periphery of said high air ratio flame by premixing the fuel and the air having an amount substantially the same as the theoretical air amount required for substantially perfect combustion.

8. A low NOx burning method according to claim 6, wherein the flame substantially completing combustion is a premixing flame burned about an outer periphery of said high air ratio flame and coaxial with said high air ratio flame by premixing the fuel and the air having an amount substantially the same as the theoretical air amount.

9. A low NOx burning method comprising the steps of: burning a low air ratio flame by premixing fuel and air having an amount less than a theoretical air amount and formed coaxial with and at a trailing stream of a premixing flame burned by premixing the fuel and air having an amount substantially the same as said theoretical air amount, and effecting combustion by supplying air required for substantial perfect combustion at a trailing stream of said low air ratio flame coaxial with said low air ratio flame.

10. A low NOx burning method comprising the steps of: burning a high air ratio flame by premixing fuel and air having an amount more than a theoretical air amount and formed coaxial with a low air ratio flame burned by premixing fuel and air having an amount less than a theoretical air amount by using a catalyst, and burning a premixing flame by premixing the fuel and air having an amount substantially the same as said theoretical air amount and formed coaxial with said high air ratio flame.

11. A low NOx burning method according to one of claims 7, 8 or 10, wherein a plurality of high air ratio flames are provided and correspond in number to a number of premixing flames burned with the air amount substantially the same as the theoretical air amount.

12. A low NOx burning method according to one of claims 7, 8 or 10, wherein the premixing flame burned with the air amount substantially the same as said theoretical air amount is a pilot flame for assisting in maintaining at least one of the low air ratio flame and high air ratio flame.

13. A low NOx burner apparatus comprising a first nozzle means for forming a low air ratio flame burned with an amount of air less than a theoretical air amount required for perfectly burning fuel, an air supplying nozzle means arranged coaxial with said first nozzle means for supplying air to burn combustibles discharged from said low air ratio flame at a trailing stream of said low air ratio flame, means for burning said low-air ratio flame by premixing the fuel and air, and means arranged in a vicinity of the low air ratio flame for maintaining the combustion of said low air ratio flame by burning a flame around an outer periphery of said low-air ratio flame, said last mentioned flame being a premixing flame burned by premixing the fuel and the air having substantially the theoretical air ratio required for substantially perfect combustion.

14. A low NOx burner apparatus comprising: a first nozzle means for forming a low air ratio flame burned with an air amount less than a theoretical air amount required for perfect burning fuel, a second nozzle means arranged coaxial with said low air ratio flame for forming a high air ratio flame burned with an air amount more than said theoretical air amount, a further nozzle means for forming a pilot flame burned with an air amount substantially the same as said theoretical air amount coaxial with said first and second nozzle means, said further nozzle means is arranged around an outer periphery of said first nozzle means and between said first and second nozzle means.

15. A low NOx burner apparatus comprising: a nozzle means for forming a low air ratio flame burned with an air amount less than a theoretical air amount required for perfectly burning fuel, a nozzle means arranged coaxial with said low air ratio flame for forming a high air ratio flame burned with an air amount more than said theoretical air amount, and combustion catalyst provided in a tip of said nozzle means for forming said low air ratio flame.

16. A low NOx burner apparatus comprising: a first nozzle means for burning fuel with an air amount substantially the same as a theoretical air amount required for perfectly burning the fuel, a second nozzle means arranged coaxial with a trailing stream of flame from said first nozzle means for forming a low air ratio flame burned with an air amount less than said theoretical air amount, and a further nozzle means arranged on a trailing stream side of said low air ratio flame for burning combustibles formed in said low air ratio flame and for supplying air having an amount substantially the same as said theoretical air amount.

17. A low NOx burner apparatus according to claim 16, wherein said low air ratio flame, said high air ratio flame and said first nozzle means for burning fuel with an air amount substantially the same as the theoretical air amount required for perfectly burning the fuel all include means for performing combustion by premixing the fuel and air.

18. A low NOx burner apparatus according to claim 17, wherein a plurality of low air ratio flames, high air ratio flames and first nozzle means for burning fuel with an air amount substantially the same as the theoretical air amount required for perfectly burning the fuel are provided and are equal in number to each other.

19. A low NOx burner apparatus comprising:

a plurality of first nozzle means for respectively forming a low air ratio flame burned with an air amount less than a theoretical air amount required for perfectly burning fuel, a plurality of second nozzle means arranged coaxial with respect to the respective first nozzle means for burning the fuel with an air amount substantially the same as said theoretical air amount, a plurality of third nozzle means arranged in a vicinity of said first nozzle means for respectively forming a high air ratio flame burned with an air amount more than said theoretical air amount, and a plurality of forth nozzle means arranged coaxial with said third nozzle means for respectively burning the fuel with an air amount substantially the same as said theoretical air amount.

20. In a low NOx burner apparatus wherein fuel is divided into primary fuel and secondary fuel independently introduced into the burner apparatus, the improvement comprising:

means for adjusting a flow rate of each of said primary and secondary fuels;

means for introducing air having an amount near a theoretical air ratio required for burning said primary fuel completely in a primary burning area for burning said primary fuel;

means for introducing said secondary fuel at a downstream side of said primary burning area in a secondary burning area wherein said secondary fuel is burned with an air amount less than that of said air ratio required for completely burning said secondary fuel;

means for introducing air having an amount enough to completely burn unburnt combustibles in said secondary burning area at a downstream side of said secondary burning area; and a plurality of burners for forming said primary burning area, wherein some of said plurality of burners are used as a supplying burner for introducing a premixed fluid obtained by premixing the fuel and air, and some of said plurality of burners form a diffusive flame by supplying only fuel or fuel and air.

21. A low NOx burner apparatus according to claim 20, wherein a part of combustion air is supplied to said secondary fuel introduced at the downstream side of said primary burning area in response to a load of a gas turbine to enable a mixing of the part of the combustion air and secondary fuel, and said secondary fuel is introduced into said burner apparatus toward a center of said burner apparatus.

22. A low NOx burner apparatus according to claim 20, wherein said plurality of burners includes a central burner for forming a diffusive flame arranged in a center of a combustion barrel, and the remaining burners of said plurality of burners forming premixing flames arranged around said central burner to discharge premixed mixtures in directions tangential to an imaginary spiral circle.

23. A gas turbine having a low NOx burner apparatus according to one of claims 13 to 22.

24. A boiler having a low NOx burner apparatus according to one of claims 13 to 22.

25. A combined power plant having a low NOx burner apparatus according to one of claims 13 to 22, wherein a gas turbine is rotated by hot exhaust gases discharged from said burner apparatus, hot exhaust gases discharged from said gas turbine are supplied to a boiler having at least one heat transfer tube therein, a steam turbine is rotated by steam obtained by said at least one heat transfer tube, and a generator is rotated by said gas turbine and said steam turbine thereby obtaining electric power.

* * * * *